US007806161B2

(12) United States Patent
Jezwinski

(10) Patent No.: US 7,806,161 B2
(45) Date of Patent: Oct. 5, 2010

(54) MOLDING AND CASTING MACHINE

(75) Inventor: Robert Jezwinski, Waupaca, WI (US)

(73) Assignee: Thyssenkrupp Waupaca Inc., Waupaca, WI (US)

( * ) Notice: Subject to any disclaimer, the term of this patent is extended or adjusted under 35 U.S.C. 154(b) by 476 days.

(21) Appl. No.: 11/953,610

(22) Filed: Dec. 10, 2007

(65) Prior Publication Data

US 2008/0135205 A1 Jun. 12, 2008

Related U.S. Application Data

(60) Provisional application No. 60/873,829, filed on Dec. 8, 2006.

(51) Int. Cl.
*B22C 9/20* (2006.01)
*B22C 15/24* (2006.01)
*B22C 5/04* (2006.01)

(52) U.S. Cl. ..... 164/27; 164/29; 164/130; 164/200; 164/323

(58) Field of Classification Search ..... 164/27–29, 164/129–130, 200–202, 322–331
See application file for complete search history.

(56) References Cited

U.S. PATENT DOCUMENTS 3,672,441 A * 6/1972 Wells et al. ..... 164/351
4,576,217 A * 3/1986 Shaw ..... 164/130
4,791,974 A 12/1988 Larsen et al.
5,332,025 A 7/1994 Larsen et al.
5,647,424 A 7/1997 Larsen et al.
5,836,373 A 11/1998 Hansen et al.
6,092,585 A 7/2000 Larsen et al.
6,481,488 B1 11/2002 Johansen et al.
6,502,620 B1 1/2003 Jacobsen et al.
6,588,488 B2 7/2003 Jacobsen et al.
6,668,904 B1 12/2003 Johansen et al.
6,698,494 B1 3/2004 Hansen et al.
6,705,382 B1 3/2004 Johansen et al.
6,796,364 B1 9/2004 Jacobsen et al.
6,808,005 B2 10/2004 Bloch et al.
6,942,008 B1 9/2005 Jacobsen et al.
7,032,641 B2 4/2006 Jacobsen et al.

* cited by examiner

*Primary Examiner*—Kuang Lin
(74) *Attorney, Agent, or Firm*—Gifford, Krass, Sprinkle, Anderson & Citkowski, P.C.

(57) ABSTRACT

Disclosed is a sand casting molding machine for double indexing molds in a mold string. The machine can include a shot chamber having sand, a swingable squeeze head, a lateral squeeze head, a core setter, a mold hold down, a mold retention device and a mold string conveyor.

28 Claims, 20 Drawing Sheets

MOLDING AND CASTING MACHINE

CROSS-REFERENCE TO RELATED APPLICATIONS

This application claims priority of U.S. Provisional Patent Application Ser. No. 60/873,829 filed Dec. 8, 2006, which is incorporated herein by reference.

FIELD OF THE INVENTION

This invention relates generally to a molding and casting machine. More specifically, the invention relates to a molding and casting machine for producing two consecutive vertical green sand molds for simultaneous double pouring.

BACKGROUND OF THE INVENTION

Metal casting is a process wherein liquid metal is typically poured into a mold having a mold cavity, allowed to solidify, and the solidified metal ejected or removed from the mold producing a part or component. A pattern is an original template from which the mold is prepared and is used to create the mold cavity in the mold material. Cores are typically placed in the mold cavity and used to produce tunnels or holes in the cast part.

During an automated molding process relatively complex machines incorporating mechanical, hydraulic and/or pneumatic systems produce a mold and then place it in a desired location. Such a molding machine can compress sand around a pattern to produce a mold-half. The mold-half is then placed in a line or string of molds and subsequently moved, also known as indexed, to a new position. The indexing of the mold-half to a new position naturally indexes the entire mold string and prevents the pouring of liquid metal into a mold cavity during this time. Current state-of-the-art machines allow for pouring only one mold cavity at a time. Once indexed to the new position, a hydraulic or pneumatic mechanical device is typically used to contact the top surface of the mold in order to hold the mold in place while subsequent operations take place. This mechanical device is commonly known as a mold hold down. Currently, mold hold downs operate from a fixed location.

After the mold-half has been moved or indexed to a new position, a filter, core, inoculants or any other item commonly used in the casting of metals can be placed within lie internal section of the mold cavity using a mechanical device known as a core setter. The filter, core, inoculants and any other item is held in place with a core mask. For highly automated operations, the core setter places a component at the same location relative to the mold cavity for each mold.

Automated molding machines allow for increased production in the casting of metal parts. However, improvements in the mold production process have resulted in the pouring of liquid metal into a mold cavity becoming the rate-determining step in the molding/casting cycle producing cast parts. Therefore, it would be desirable to have a molding machine that allows for the pouring of two molds simultaneously while said machine produces two additional molds.

SUMMARY OF THE INVENTION

Disclosed is a sand casting molding machine for making and then double indexing molds in a mold string. The machine can include a shot chamber having sand, a lateral squeeze head, a swingable squeeze head, a core setter, a mold hold down, a mold retention device and a mold string conveyor. The molding machine can also include a pair of safety bars which afford the locking in place the lateral squeeze head when the swingable squeeze head is in an up position, during core setting and during the change of a pattern plate that is attached to the lateral and/or swingable squeeze head.

The lateral squeeze head can include a plurality of linear sensors, round air shoes, cam action adjusting bolts and a hydraulic pattern lock that afford for detection of the location of the lateral squeeze head during operation of the molding machine, support of the lateral squeeze bead above a wear sheet, easy adjustment of vertical and lateral location of the lateral squeeze head, and secure holding of a pattern plate onto the lateral squeeze head, respectively. The swingable squeeze head has a plurality of linear sensors, a swing pivot assembly and a read/write electronic head. The linear sensors afford for monitoring the position of the location of the swingable squeeze head during operation and the swing pivot assembly provides for improved swing movement. The read/write electronic head affords for identification of the particular pattern plate on the swingable squeeze head, thereby assisting in the set up of the sand casting molding machine operational parameters for a particular mold production run.

The core setter can include a servo motor with a gear setter and a double linkage system. The servo motor, in combination with the gear setter and double linkage system, affords for optimum acceleration and deceleration of a core setter mast. The core setter mast can include a linear sensor with an adjustment block that can monitor the location of alignment pins on a core setting mask attached to the mast, with feedback on the pin locations provided to an operator panel. The core setter mast can also include a read/write electronic head that affords for the identification of a particular core mask, thereby assisting in the setup of the sand casting molding machine.

A pattern plate with a data carrier component that stores processing information during the use of the pattern plate can be included. In addition, the pattern plate can include guide rails that fit on at least one roller or fitting on the swingable squeeze head and/or the lateral squeeze head to afford for increased ease of installment or removal of the pattern plate.

After a mold exits the sand chamber, it can be placed at the end of the mold string and held at this location using a mold retention device that provides a steady pressure on the mold (s) as the mold string is doubled indexed. The mold retention bars use a cam lever action to apply the steady pressure and the cam action prevents the mold string from expanding back towards the sand chamber. Proximate the mold retention device is the mold hold down which can include a plurality of clamp heads that apply pressure across the top of a mold without crushing the mold. The plurality of clamp heads can operate independent of each other such that if an obstacle such as a pour cup is in the way of a particular clamp head, this clamp head can be positioned in the up or unactivated state.

The mold string conveyor can include V-rail runner bars and bearings that provide for a more accurate alignment of the mold string and minimizes mold shifting. In addition, sealed adjuster blocks are provided that afford for easier adjustment of conveyor rails. The conveyor can have movable waffles that are connected with spreader bars, the spreader bars affording alignment of the waffles relative to each other, support of the V-rail runner bars with reduced deflection and removal of the movable waffles without additional support. The movable waffles can be actuated with a penetrable sixty degree rotary actuator, thereby reducing the stress and load thereon.

DETAILED DESCRIPTION OF THE INVENTION

Figure 1:
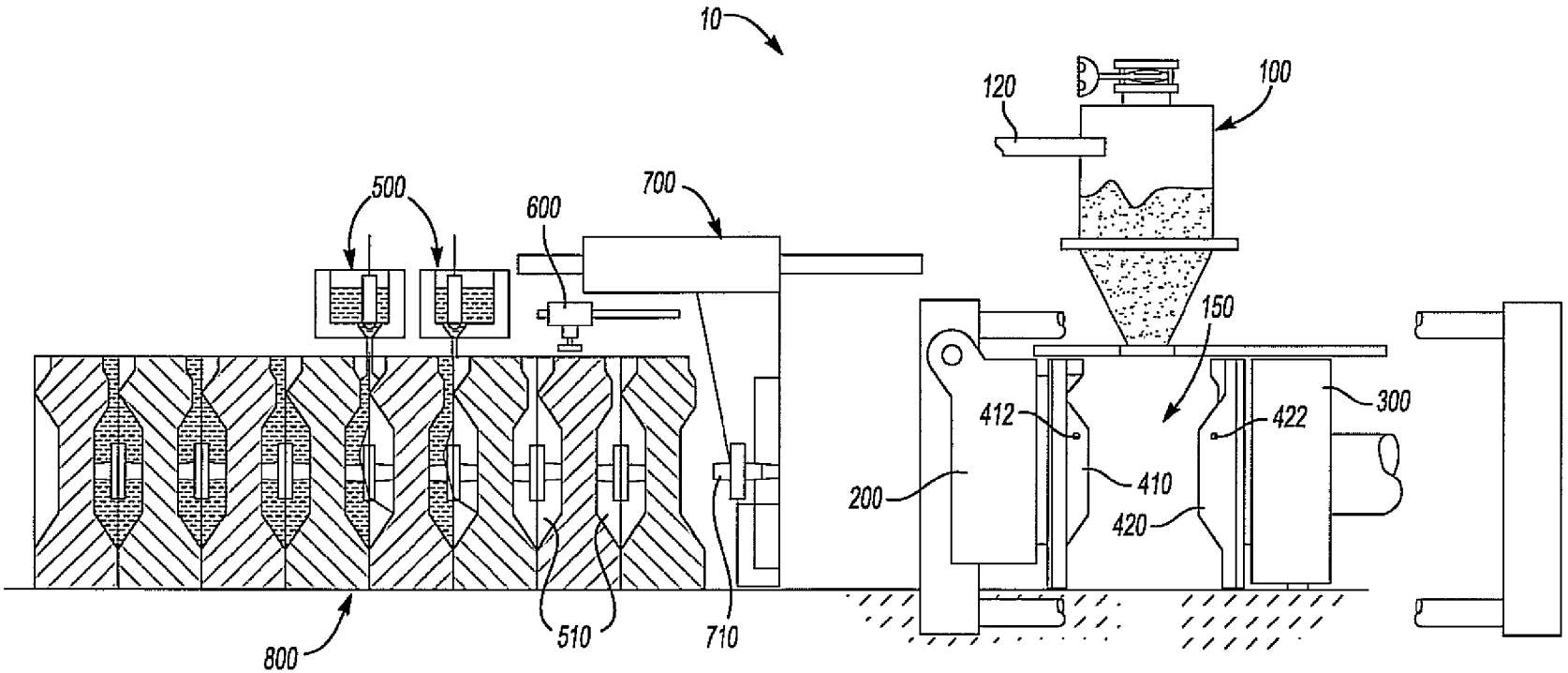
FIG. 1 is a side view schematically illustrating an embodiment of the present invention wherein two mold cavities in a mold string are being poured simultaneously.

The present invention discloses a molding machine that produces sand molds and then double indexes the molds in a mold string. The double indexing affords for a longer pour time between indexing and thus increased productivity of the molding machine. As such, the present invention has utility as sand casting molding machine and a method for producing molds and castings with increased efficiency. The term "double indexing" is defined as the movement of a string or row of molds or mold halves, also known as a mold string, the distance of two molds or two mold halves, as opposed to the current state of the art single indexing.

The molding machine can include a wear sheet, a shot chamber having sand, a mold chamber, a lateral squeeze head, a swingable squeeze head, a core setter, a mold retention device, a mold hold down, and a mold string conveyor. In addition, the molding machine has a pair of safety bars which afford for the locking in place of the lateral squeeze head when the swingable squeeze head is in an up position, during core setting, and/or during changing of a pattern plate that is attached to one of the squeeze heads. The wear sheet is the reference component of the molding machine with all other components having a position or range of positions relative to the wear sheet.

The lateral squeeze head is attached to a lateral squeeze head cylinder that slides through a bushing and a flange. The flange can include a linear sensor attached thereto, the sensor providing information on the displacement of the lateral squeeze head cylinder relative to the bushing and/or flange. In addition, the lateral squeeze head and the swingable squeeze head can have linear sensors that monitor the location of the respective squeeze head during operational movements, the display of this location information optionally provided to an operator panel. An operator panel is defined as a display whereon information related to the operation of the sand casting machine can be presented and observed by an operator.

The lateral squeeze head can also include a pair of round air shoes that provide support to the lateral squeeze head above the wear sheet. A hydraulic pattern lock can be included as part of the lateral squeeze head and/or swingable squeeze head, the hydraulic pattern lock affording for rigid attachment of a pattern plate onto the respective squeeze head.

In addition to the swingable squeeze head having linear sensors, it can also have a swing pivot assembly and an electronic read/write head. The swing pivot assembly attaches the swingable squeeze head to a yoke assembly and can include a swing pivot pin that is at least partially within a self-lubricated bushing. The bushing provides radial support to the pivot pin. Axially adjacent to the bushing can be an angular ball bearing assembly providing axial support to the pivot pin. An outer cap with threads can be included, the threads affording for the outer cap to be screwed onto an outer sleeve radially adjacent to the bushing. Screwing the outer cap onto the sleeve affords for adjustment of the amount of pressure to be applied to the angular ball bearing assembly and thus how tight the bearing assembly will fit against the pivot pin. Pattern plates that can be attached to the lateral squeeze head and/or the swingable squeeze head can include guide rails that afford for increased ease of installment and removal of the pattern plates on and off the squeeze heads.

The core setter replaces heretofore used hydraulic actuators with a servo motor to move a core mask with a core attached thereto into position with respect to a mold cavity. The servo motor can work in cooperation with a gear setter and a double linkage system. The servo motor, gear setter and double linkage system optimize the acceleration and deceleration characteristics of the servo motor and thereby afford for relatively fast and predictable movement of the core setter. Also included as a part of the core setter can be a braking cylinder affording a quick stop of the core setter. The core setter has a core setting mast to which the core mask attaches to, the mast having a linear sensor and an adjustment block with a wedge-shaped surface. The linear sensor monitors the location of the adjustment block using the wedge-shaped surface and thereby monitors the location of alignment pins attached to the core setting mask. The location of the pins in the core setting mask provides information to an operator as to whether or not a core is being accurately placed within a mold cavity. The core setting mast can also include an electronic read/write head that communicates with another electronic read/write head that is attached to a core setting mask attached to the mast. Communication between the mast and mask read/write heads affords for identification of the particular mask attached to the mast which can assist in the setup of the molding machine operational parameters. In some instances, the identification of the mask attached to the mast using the electronic read/write heads can prevent human error in the programming of the operational parameters for the sand casting molding machine.

Once a mold has been formed by blowing sand into the mold chamber and squeezing the sand with pattern plates that are attached to the lateral squeeze head and the swingable squeeze head, the lateral squeeze head is used to push the mold to a location at the end of a mold string. The mold string is held in place using a mold retention device, the mold retention device having at least one mold retention bar that applies constant pressure on the mold string using a cam lever action. The cam lever action prevents the mold string from expanding back towards the mold chamber. In addition to the mold retention device, a mold hold down can be included, the mold hold down having a plurality of clamp heads that apply pressure to the top of a mold without crushing the mold. The plurality of clamp heads can operate independent of each other such that one or more clamp heads can be placed in an up state or unactivated state while the remaining clamp heads apply pressure to the top of a mold.

The mold string is at least partially located on a mold string conveyor. The mold string conveyor can include V-rail runner bars, the runner bars in contact with bearings. The location of the V-rail runner bars relative to the bearings provide a more accurate alignment of the mold string conveyor and minimizes mold shifting. Located adjacent to the bearings are sealed adjuster blocks, the sealed adjuster blocks providing easier adjustment of the V-runner rails and affording for such adjustment at a distance spaced apart from the floor.

The mold string conveyor can also include two sets of movable waffles, sometimes known as splice plates. Each set of movable waffles are connected with spreader bars, the spreader bars providing alignment of the waffles relative to each other and support for the V-rail runner bars. In addition the spreader bars afford for reduced deflection of the V-rail runner bars and removal of movable rails without having to support the movable waffles. Actuating the movable rails can include the use of a sixty degree rotary actuator. The rotary actuator improves the lifting of the waffles and, the rotary actuator directly coupled to a lifting camshaft as opposed to a linear actuator of prior art machines.

Figure 2:
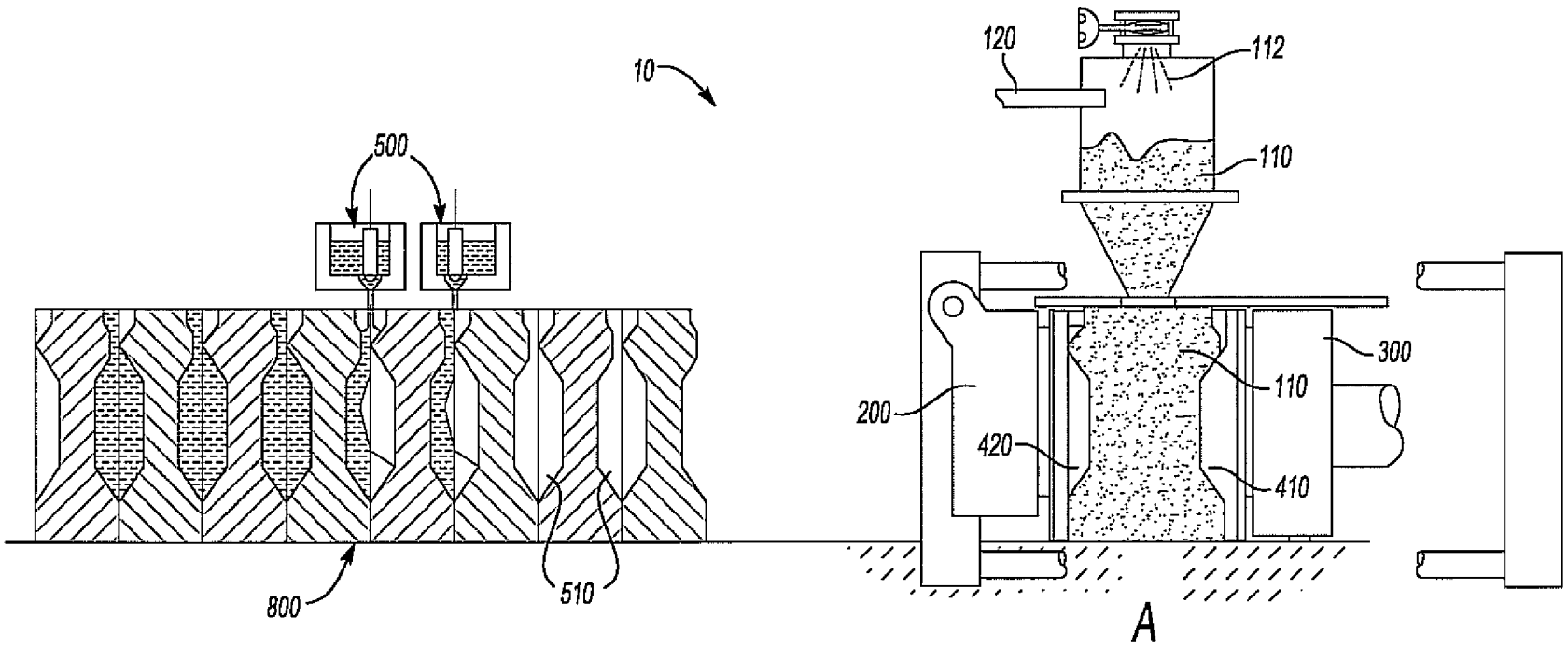
FIG. 2 is the embodiment shown in FIG. 1 wherein sand has been blown into a sand chamber.

Turning to FIG. 1, an inventive molding machine 10 includes a shot chamber 100, a swingable squeeze head 200, a lateral squeeze head 300, pattern plates 410 and 420, pouring vessels 500, a mold hold down 600 and a core setter 700. During operation of the molding machine 10, sand 110 from the shot chamber 100 is forced into a molding chamber 150 between the pattern plates 410 and 420 using compressed air 112, as shown in FIG. 2. Although not illustrated in the figures, core setting can be performed during this step if required. In addition, pouring of liquid metal from the pouring vessels 500 into two mold cavities 510 is assumed during this step and other steps hereafter unless stated otherwise.

Figure 3:
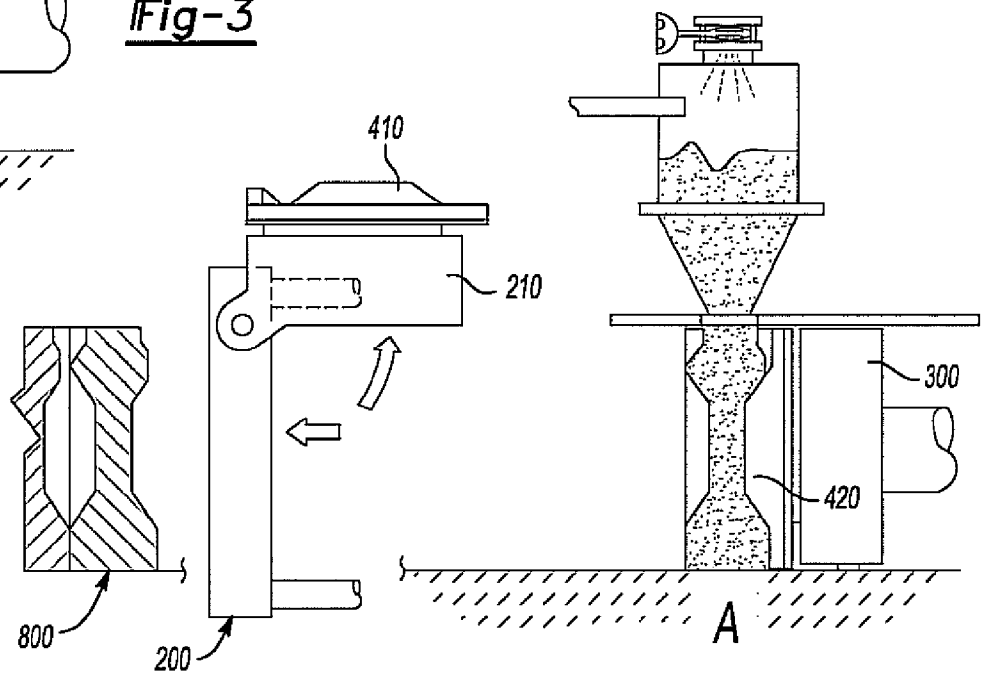
FIG. 3 is the embodiment shown in FIG. 2 wherein the sand in the sand chamber has been squeezed.
Figure 4:
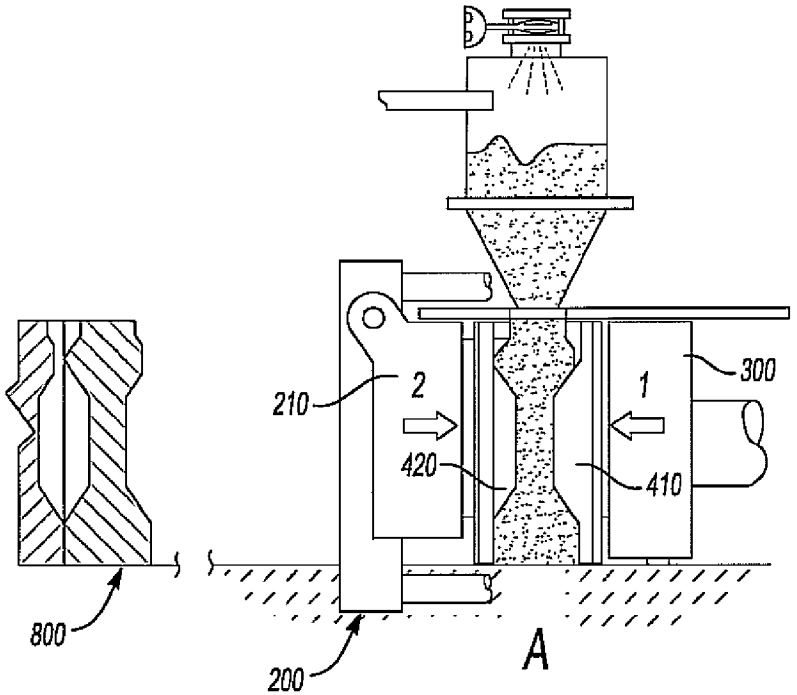
FIG. 4 is the embodiment shown in FIG. 3 wherein a swingable squeeze head has been placed in an up position.
Figure 5:
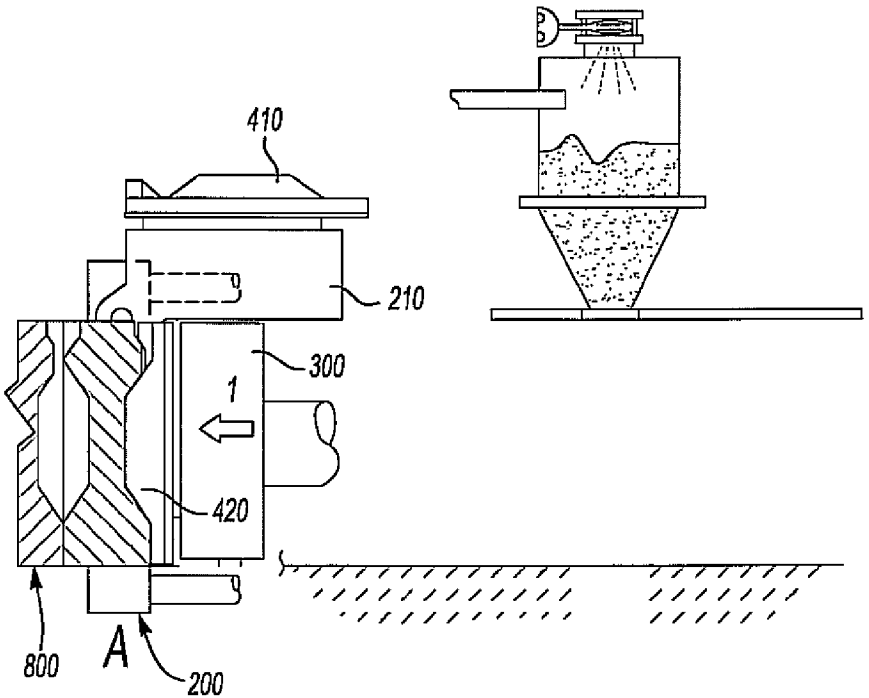
FIG. 5 is the embodiment shown in FIG. 4 wherein a sand mold has been pushed out of the sand chamber and at the end of the mold string.

After the sand from the shot chamber 100 is forced between the pattern plates 410 and 420 as shown in FIG. 2, a green sand mold-half A is produced by applying force in a first direction 1 to the pattern plate 420 with lateral squeeze head 300 and applying force in a second direction 2 to the pattern plate 410 with swingable squeeze head 200 (FIG. 3). Turning to FIG. 4, after the mold-half A has been produced, the swingable squeeze head 200 with the pattern plate 410 is removed from the mold-half A and rotated to an out-of-the-way position. The out-of-the-way position is a position that affords for the mold half A to be pushed from the mold chamber 150 to the end of the mold string 800. In some instances, the swingable squeeze head 200 with the pattern plate 410 is rotated to a generally horizontal position. The lateral squeeze head 300 is then allowed to push the mold-half A in the first direction 1 to a position where it contacts the mold string 800, as shown in FIG. 5.

Figure 6:
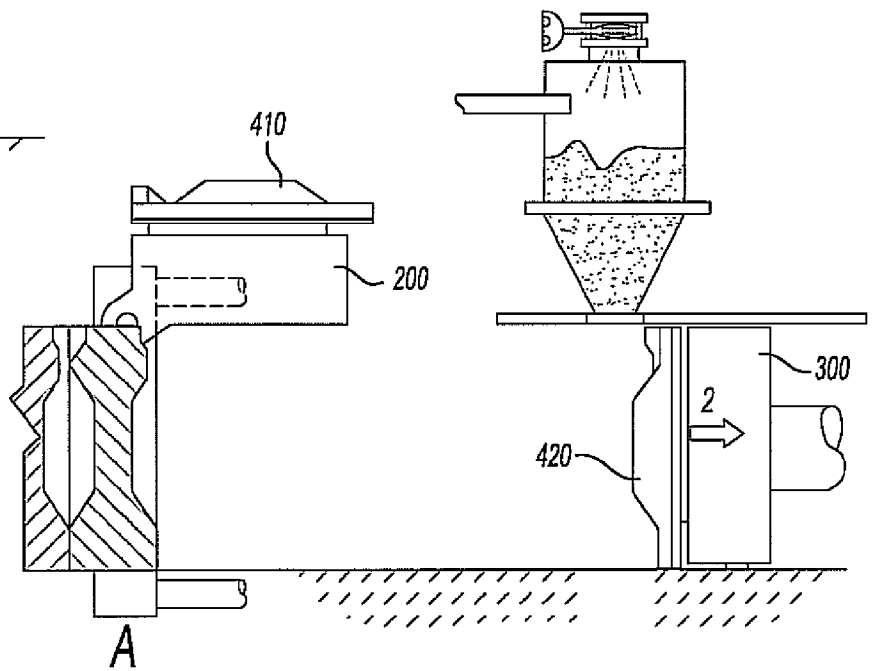
FIG. 6 is the embodiment shown in FIG. 5 wherein the lateral squeeze head has been returned to an original position.

After the mold-half A comes into contact with the mold string 800, the mold hold downs 600 are used to hold mold-half A stationary (not shown in FIG. 5) and the lateral squeeze head 300 with the pattern plate 420 is stripped or removed from the mold-half A and returned to its original position (FIG. 6).

Figure 7:
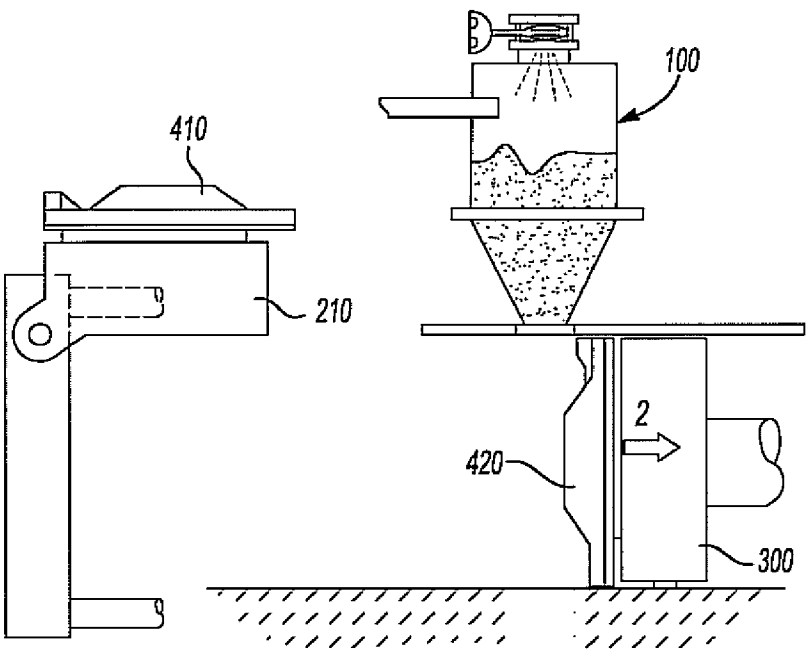
FIG. 7 is the embodiment shown in FIG. 5 wherein an additional sand mold has been placed at the end of the mold string.

The next mold-half—mold-half B—is produced in an identical manner and, similar to the mold-half A, is subsequently pushed into contact with the mold string 800 using the lateral squeeze head 300 moving in the first direction 1 (FIG. 7). When the mold-half B has come into contact with the mold-half A, the entire mold string 800 can be indexed in the first direction 1 the distance of two molds, two mold halves and/or two mold cavities, instead of just one. Only during this indexing operation is the pouring of the mold cavities 510 by the pouring vessels 500 forced to stop. It is appreciated that the double indexing of the molds can be accomplished by the lateral squeeze head 300 pushing the mold string 800. It is also appreciated that a mold string conveyor can move the mold string 800 in-sync with the lateral squeeze head 300 pushing the mold string 800.

Figure 8:
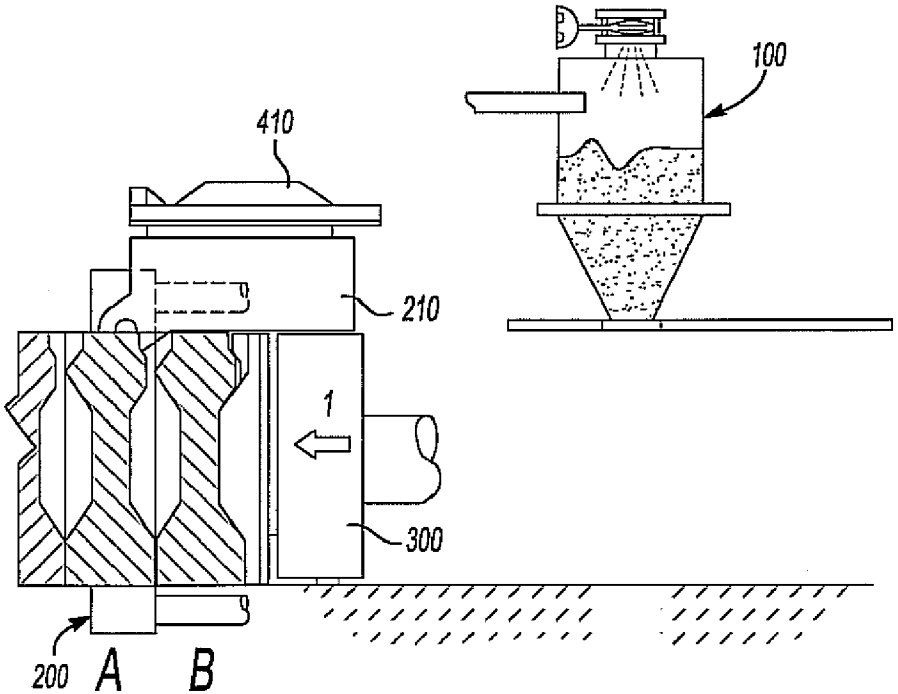
FIG. 8 is the embodiment shown in FIG. 7 wherein the lateral squeeze head has been returned to an original position.
Figure 8:
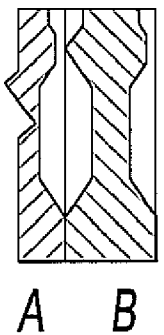
Figure 9:
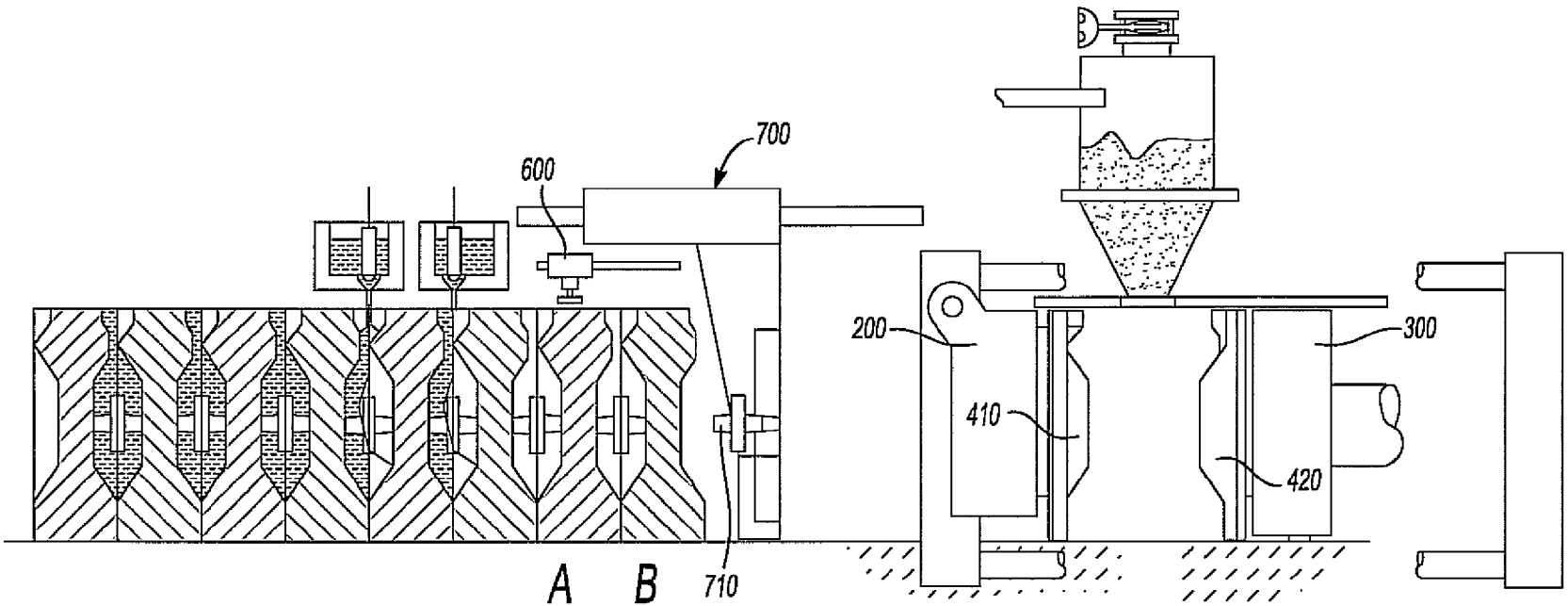
FIG. 9 is the embodiment shown in FIG. 1 illustrating that a cycle to index two molds at the same time has been completed and the next two mold cavities in the mold string are being poured.

After the indexing operation, the new mold-half B can be held in a fixed position with the mold hold down 600. Then the lateral squeeze head 300 with the lateral head pattern 420 is removed or stripped from the mold-half B and returned to its starting position (FIG. 8). It is appreciated that after the swingable squeeze head 200 returns to its starting position a core setter 700 can insert a core 710, filter, inoculants, etc., into the mold-half B or mold cavity 510 at the present indexed position (FIG. 9). Once the indexing operation has been completed and the new mold-half B is held in position using the mold hold downs 600, the pouring of the mold cavities 510 using the pouring vessels 500 can be continued. In some instances, the pouring of the two mold cavities 510 as shown in FIG. 1 will be completed prior to the double indexing operation and the pouring of the next two mold cavities can be initiated after the double indexing operation. In this manner, a more productive molding machine and/or method of casting metallic components are provided.

Figure 10:
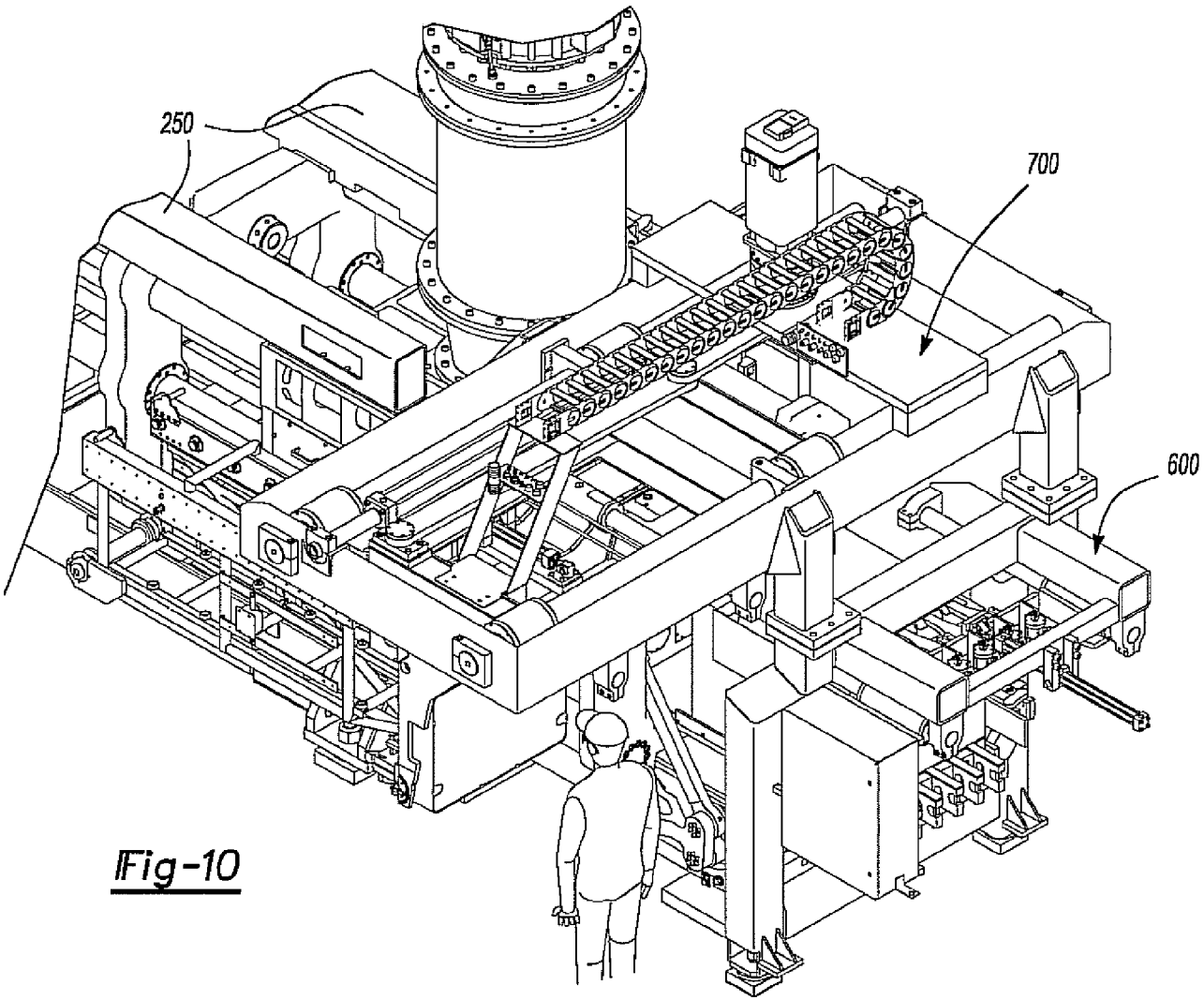
FIG. 10 is a top perspective view of a pair of safety bars on an embodiment of the present invention.

Looking now at FIG. 10, a top perspective view of the molding machine is shown wherein a pair of safety bars 250 are shown. As shown in this figure, the safety bars 250 afford support for fixedly clamping of the lateral squeeze head 300 such that movement of the head 300 is terminated when desired. The safety bars 250 afford for automatic termination of the movement of the molding machine when the swingable squeeze head is in an up position, during core setting, and during the changing of a pattern plate. The safety bars 250 therefore eliminate the need for a manual tie rod safety bar to be placed and attached to a yoke assembly 900 during maintenance, changing of patterns, and the like.

Figure 11:
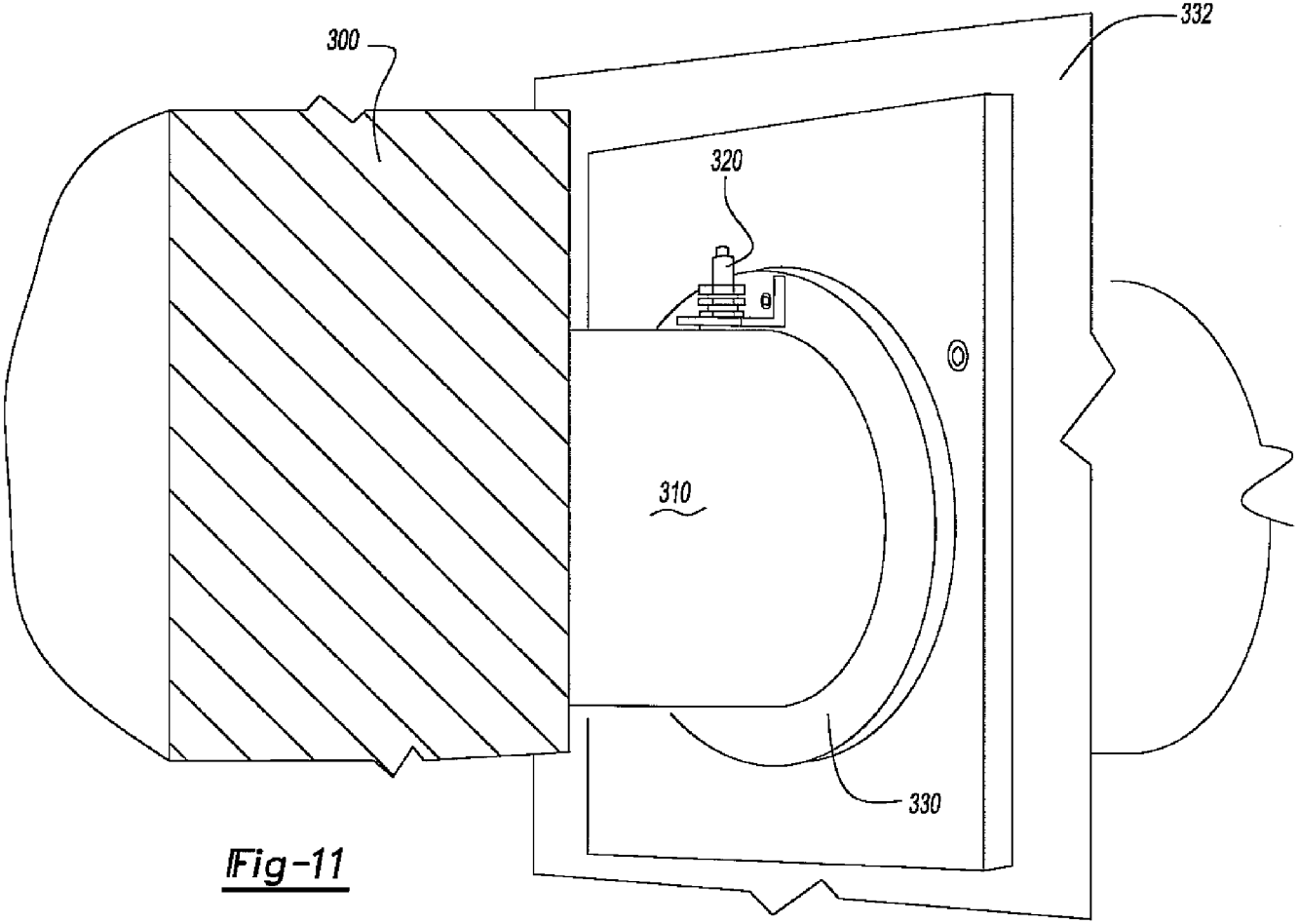
FIG. 11 is a perspective view of a lateral squeeze head cylinder with a linear sensor.

The lateral squeeze head 300 has a lateral squeeze head cylinder 310 attached thereto (FIG. 11) that slides through a bushing (not shown) and a flange 330, the bushing and flange 330 being part of a cylinder support member 332. The flange 330 can have a linear sensor 320 attached to it, the sensor 320 affording information on the displacement of the cylinder 310 relative to the flange 330 and/or bushing. Thus the linear sensor 320 can provide information as to whether or not excessive wear is occurring during the sliding of the cylinder 320 in the first direction 1 and the second direction 2. The linear sensor 320 can be an inductive proximity linear sensor known to those skilled in the art, illustratively including inductive proximity sensors available through Pepperl+Fuchs of Twinsburg, Ohio. In addition, the linear sensors disclosed herein can be attached to the respective component using any means or device known to those skilled in the art, illustratively including brackets, adhesives, hook and loop fasteners, other types of fasteners and the like.

Figure 12:
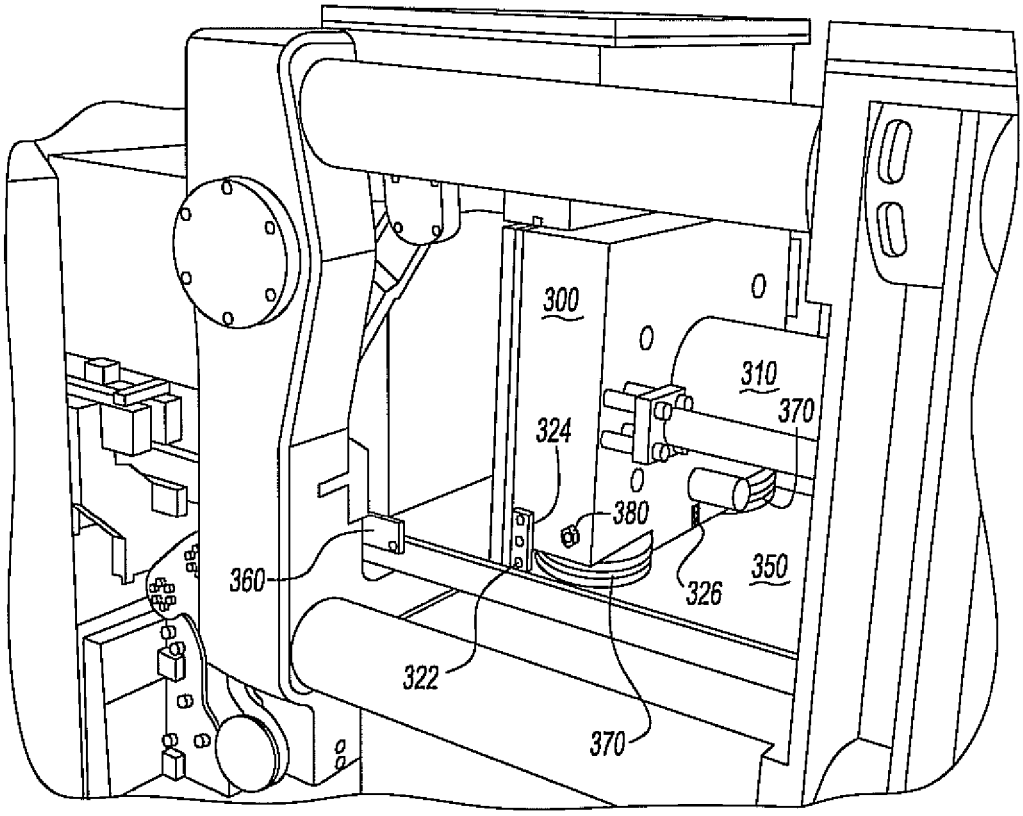
FIG. 12 is a perspective view of a lateral squeeze head.

The lateral squeeze head 300 can also include a plurality of linear sensors that monitor the vertical and/or lateral location of the lateral squeeze head. For example and for illustrative purposes only, FIG. 12 shows a linear sensor 322 located within a positioning block 324 that is attached to the lateral squeeze head 300. The linear sensor 322 can monitor the lateral position of the lateral squeeze head 300 when the head 300 is inside the mold chamber 150 and optionally monitor the lateral position of the head 300 when it passes a mold strip guide 360. A similar lateral sensor can be located on the opposite side of the lateral squeeze head 300 and this is not shown in the figure. Also shown in FIG. 12 is a linear sensor 326 located proximate the bottom of the lateral squeeze head 300, the sensor 326 monitoring the vertical position of the head 300 relative to a wear sheet 350.

A pair of round air shoes 370 can be attached to a bottom surface of the lateral squeeze head 300, the air shoes 370 affording support of the lateral squeeze head 300 relative to the wear sheet 350. In addition, cam action adjusting bolts 380 can be included, the bolts 380 affording for adjustment of the vertical position of the lateral squeeze head 300 relative to the wear sheet 350.

Figure 13:
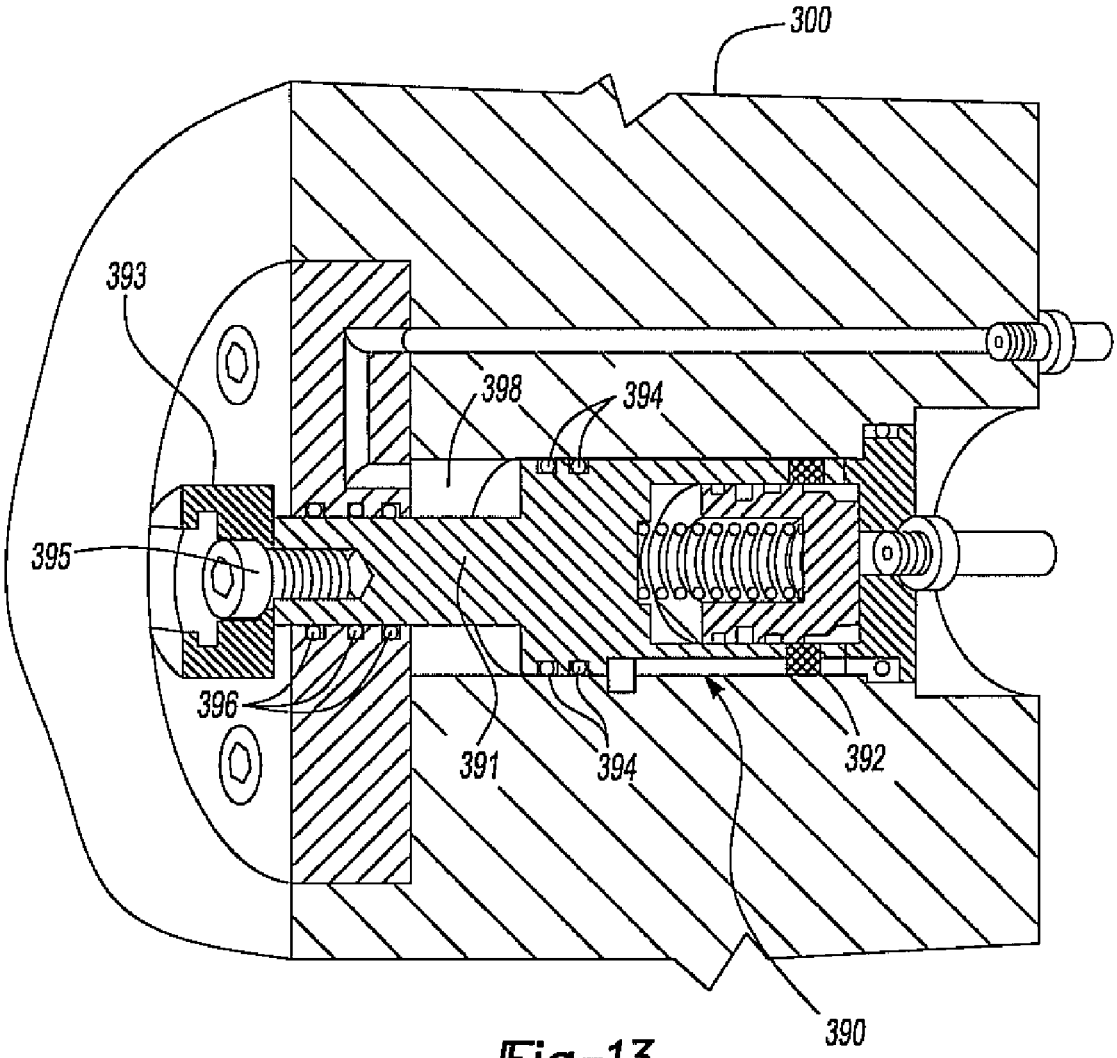
FIG. 13 is a side cross-sectional view of a hydraulic pattern lock.

Turning to FIG. 13, a hydraulic pattern lock 390 can be included at least partially within the lateral squeeze head 300. The hydraulic pattern lock 390 can include wear bands 392, scrapers 394 and seals 396 in order to reduce the amount of contamination into the cylinder 398. The hydraulic pattern lock 390 includes a central shaft 391 that has a locking cap 393 attached at the end thereof using a threaded member 395. The locking cap 393 is replaceable and thereby affords for the entire shaft 391 not having to be removed from within the cylinder 398 when replacement of the locking cap 393 is desired. It is appreciated that the locking cap 393 is operable to rigidly attach to a complementary member on the back side of a pattern plate 420 and thereby afford for the hydraulic pattern lock 390 to securely hold the pattern plate 420 against the lateral squeeze head 300. It is also appreciated that a similar hydraulic pattern lock can be included as part of the swingable squeeze head 200 and that a plurality of hydraulic pattern locks can be included as part of the lateral squeeze head 300 and/or swingable squeeze head 200.

Figure 14:
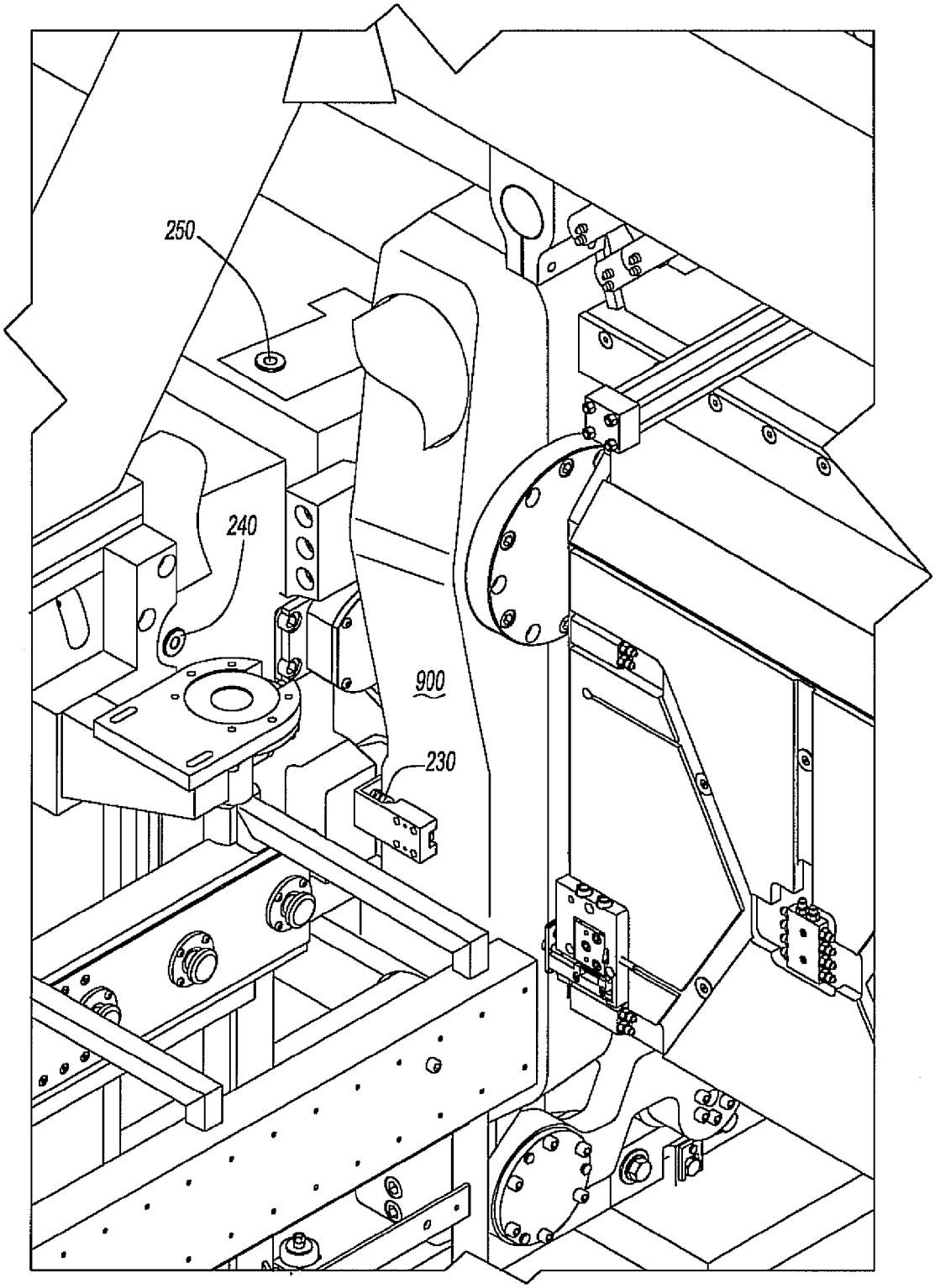
FIG. 14 is a perspective view of a swingable squeeze head having linear sensors.

The swingable squeeze head 200 can include a number of features that afford for accurate placement of the squeeze head within the mold chamber 150 and quick and efficient removal therefrom. FIG. 14 illustrates a plurality of linear sensors that afford for monitoring of the position of the swingable squeeze head 200. For example, a linear sensor 230 can be attached to the yoke assembly 900 and be used to monitor the position of the swingable squeeze head 200. In addition, the swingable squeeze head 200 can itself have a linear sensor 240 and a linear sensor 250 that monitor the lateral and vertical position, respectively, of the swingable squeeze head 200 when the head 200 is in the mold chamber 150.

Figure 15:
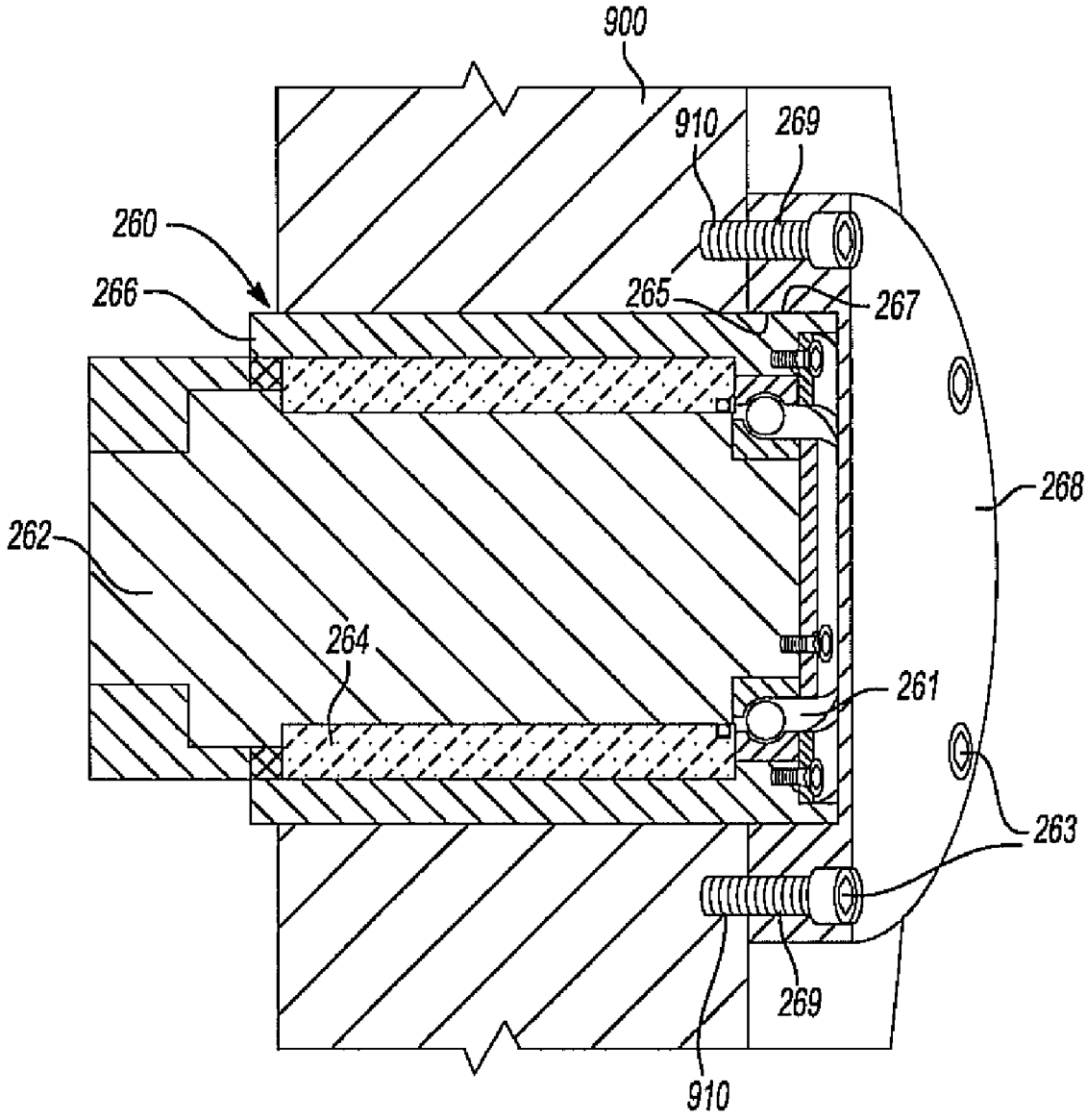
FIG. 15 is a side cross-sectional view of a swing pivot assembly for the swingable squeeze head.

The swingable squeeze head 200 can also include a swing pivot assembly 260 attaching the head 200 to the yoke assembly 900 as shown in FIG. 15. The swing pivot assembly 260 can include a swing pivot pin 262, a bushing 264, an outer sleeve 266 and an outer cap 268. The bushing 264 can be a self-lubricated bushing, illustratively including an aluminum-bronze bushing with graphite-impregnated plugs. In this manner, permanent lubrication of the pivot pin 262 is provided. The outer cap 268 can have threads 267 that are complementary to threads 265 on the outer sleeve 266, thereby affording for the outer cap 268 to be threaded onto the outer sleeve 266. As illustrated in this figure, the outer cap 268 includes a plurality of apertures 269 in which threaded members 263 can be used to attach the outer cap 268 to the yoke assembly 900 having threaded apertures 910. The location of the apertures 269 and 910 are such that threading the outer cap 268 onto the outer sleeve 266 results in an adjustment in an axial direction of the pivot pin 262 of 0.002 inches for every bolt-aperture alignment. Optionally included can be an angular ball bearing assembly 261, the assembly 261 providing radial support to the pivot pin 262. Thus the outer cap 268 being threaded onto the outer sleeve 266 can be used to adjust the location and/or the tightness of the angular ball bearing assembly 261 relative to the pivot pin 262. In some instances, the angular ball bearing assembly 261 is a four-point angular ball bearing assembly.

The swingable squeeze head 200 can also include an electronic read/write head (not shown), the head operable to read and/or write to a corresponding electronic read/write head that is attached to the pattern plate 410. In this manner, the read/write head attached to the swingable squeeze head 200 can assure that the correct pattern plate is attached and assist in the setting up of the molding machine operational parameters. In some instances, the identification of the pattern plate attached to the squeeze head using the electronic read/write heads can prevent human error in the programming of the operational parameters for the sand casting molding machine.

Figure 16:
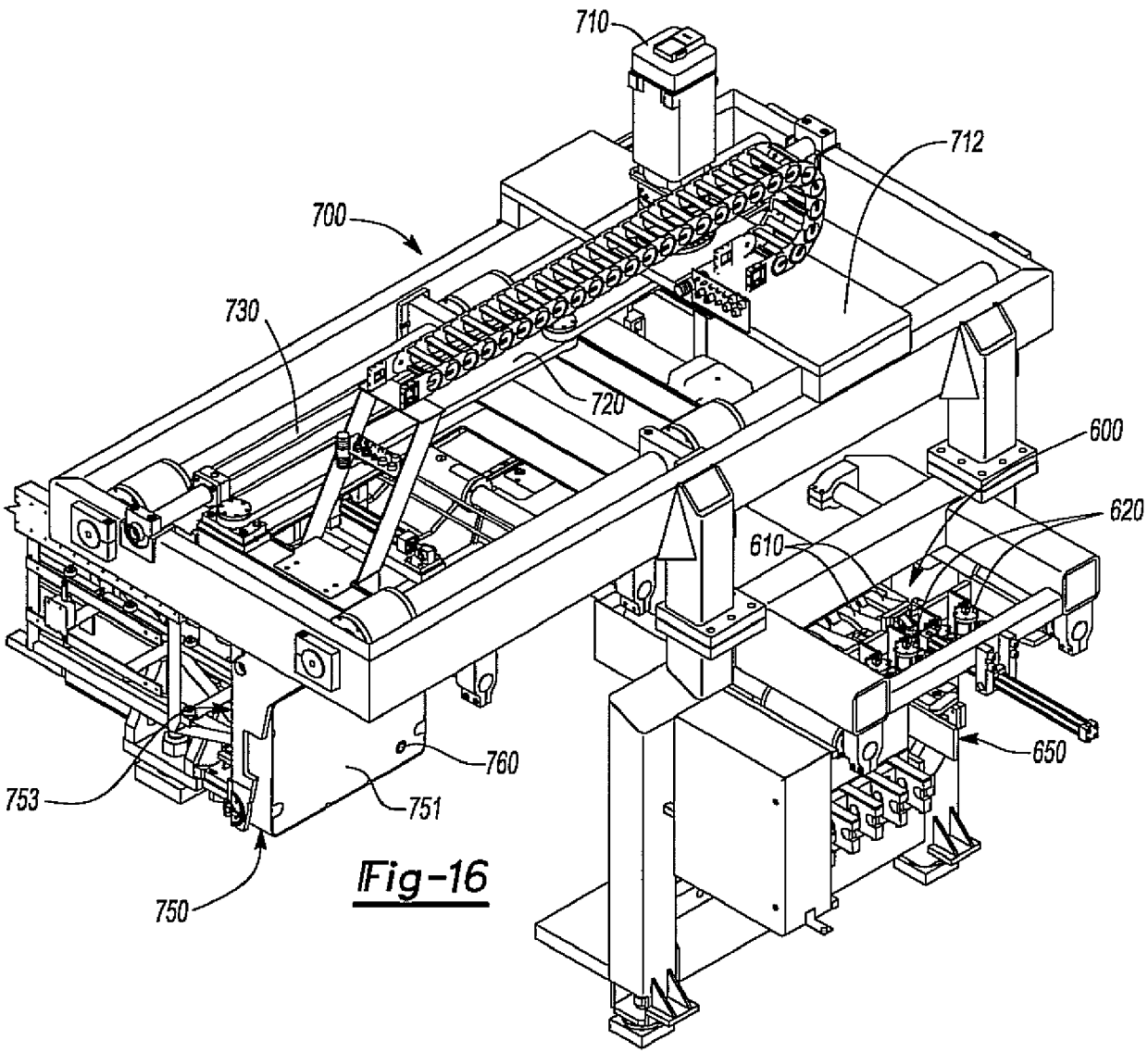
FIG. 16 is a top perspective view of a core setter, mold retention device and mold hold down.
Figure 17:
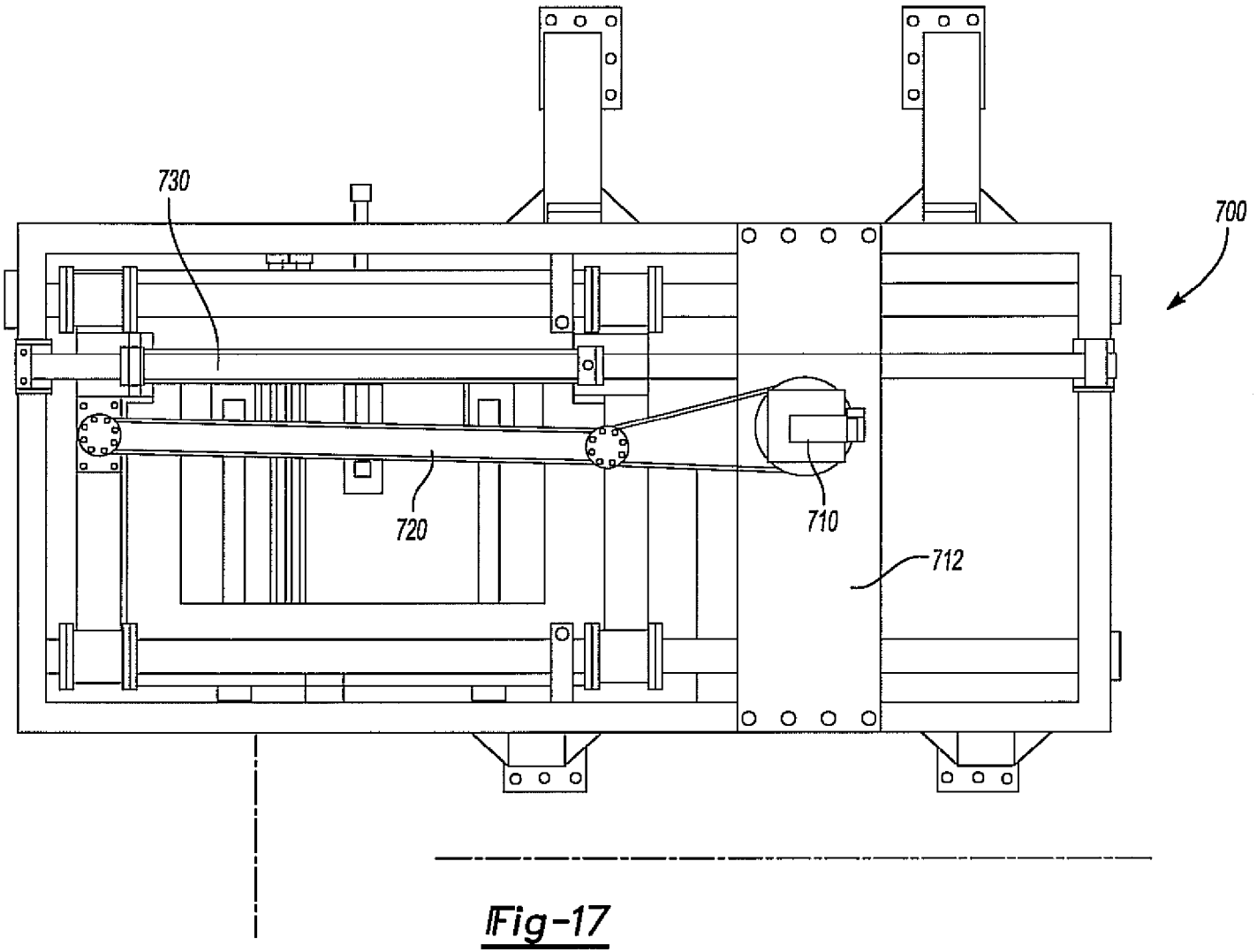
FIG. 17 is a top view of a core setter.
Figure 18:
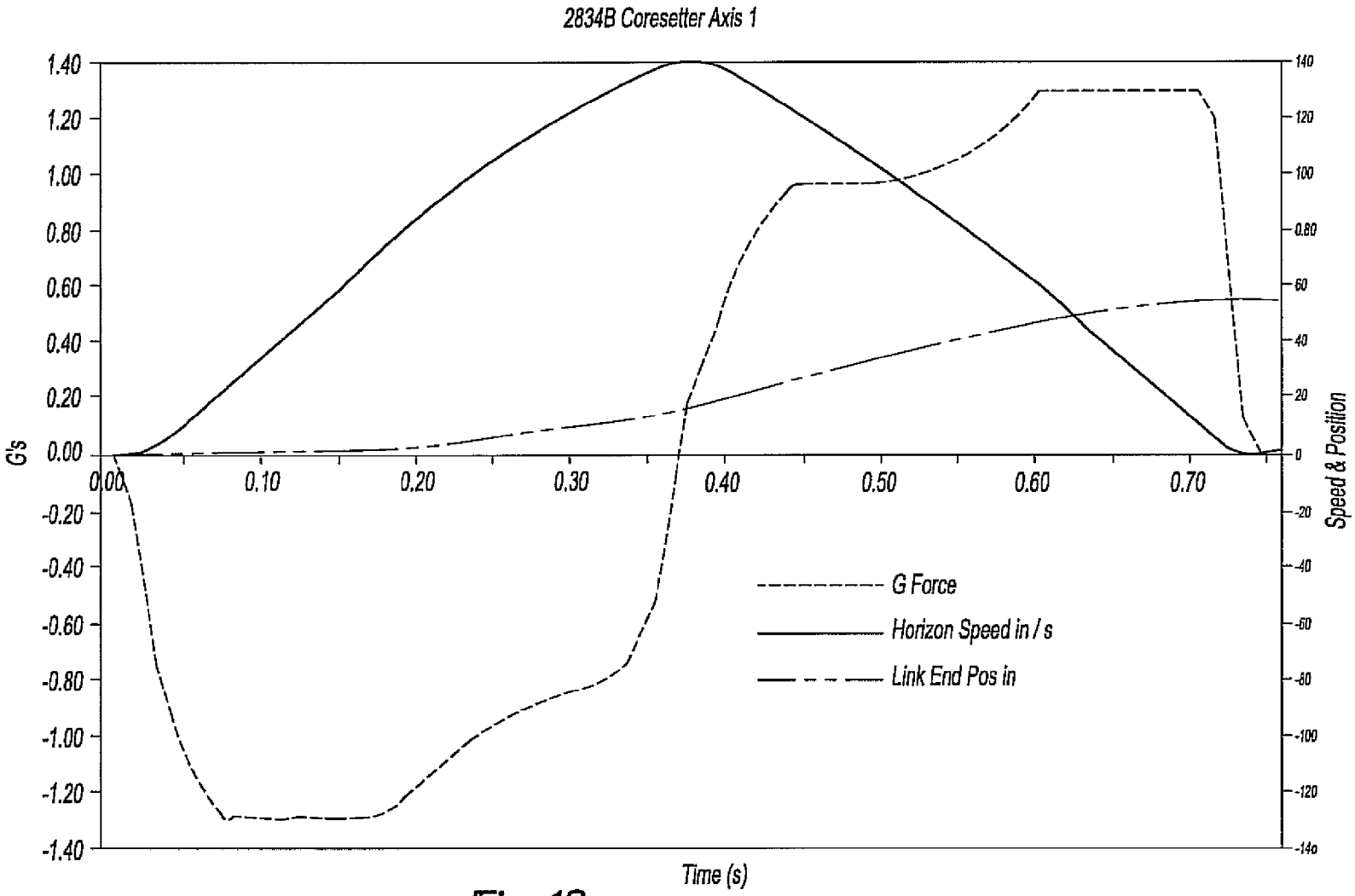
FIG. 18 is a graphical representation of the G-force, speed and position of a core setter mast.

Looking now at FIGS. 16 and 17, a perspective view and top view, respectively, of a core setter 700 are shown. The core setter 700 can include a servo motor 710, a gear setter (not shown), a double linkage member 720 and a braking cylinder 730. The servo motor 710 in combination with the gear setter and the double linkage member 720 affords for optimum acceleration and deceleration along a long axis of the core setter 700 as illustrated by the graph shown in FIG. 18, wherein the G-force, speed and position of the core setter 700 is shown. The core setter includes a core setting mast 750 with a mold string side 751 and a mold chamber side 753. The mast 750 can have a core setting mask (not shown) attached thereto, the mask operable to have a core, filter and the like attached to it. The gear setter can be located on the opposite side of a mounting plate 712 from the servo motor 710 and serves as a gearbox planetary reduction system which can have gear ratios that optimize the motions involved in placing of a core within the mold cavity.

Figure 19:
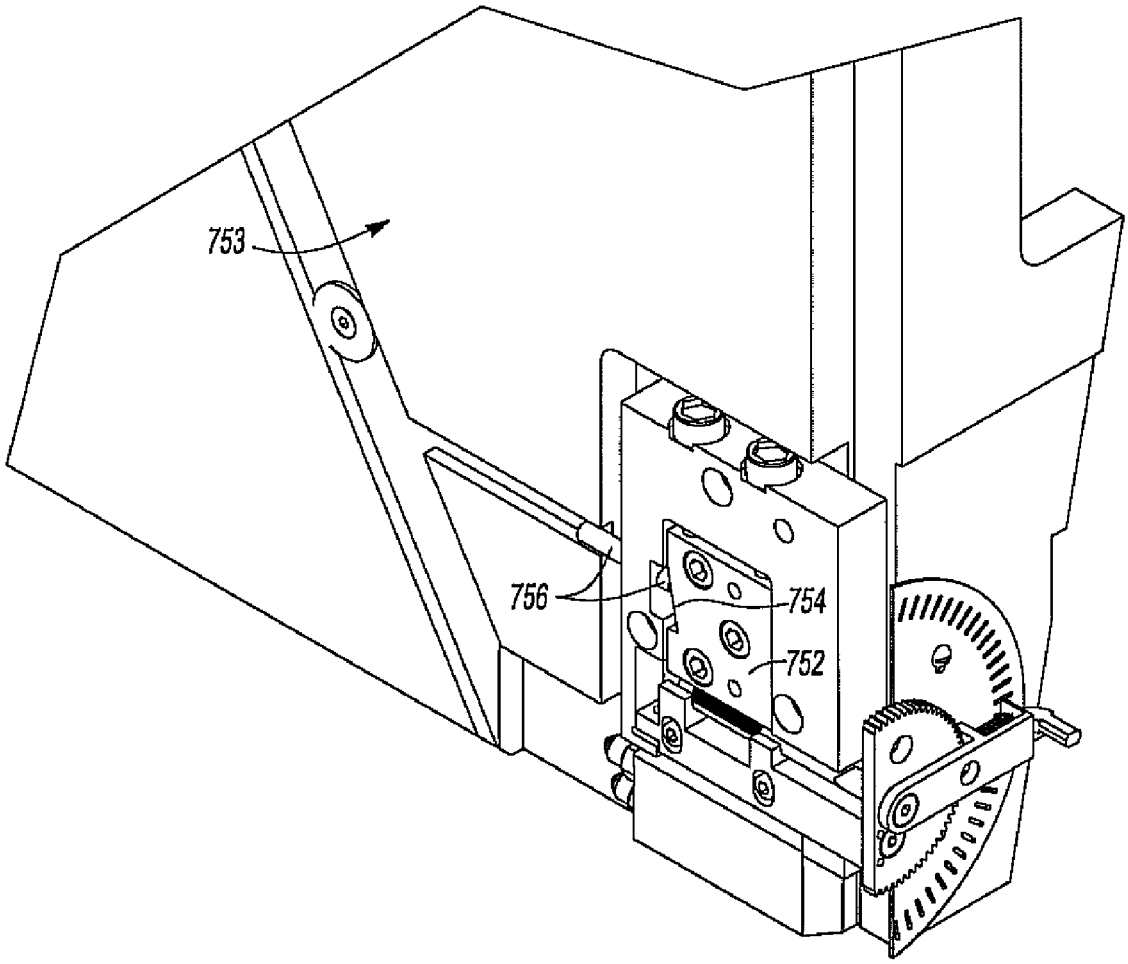
FIG. 19 is a perspective view of a portion of a core setter mast.

A portion of the mold chamber side 753 of the core setting mast 750 is shown in FIG. 19 wherein an adjustment block 752 having a wedge-shaped surface 754 is located proximate to a linear sensor 756. The linear sensor 756 monitors the position of the adjustment block 752 relative to the mast 750 using the wedge-shaped surface 754. In addition, the adjustment block 752 has a fixed distal relationship to alignment pins (not shown) that are located on a core setting mask that is attached to the mold string side 751 of the mast 750. In this manner, the linear sensor 756 affords for the monitoring of the position of the mask and any core, filter and the like attached thereto, relative to the mast. As such, the alignment and/or position of a core relative to the core setting mast 750 and a mold cavity can be provided to the operator panel, and if misalignment and/or undesirable positioning of the core is present, corrective action can be taken.

Figure 20:
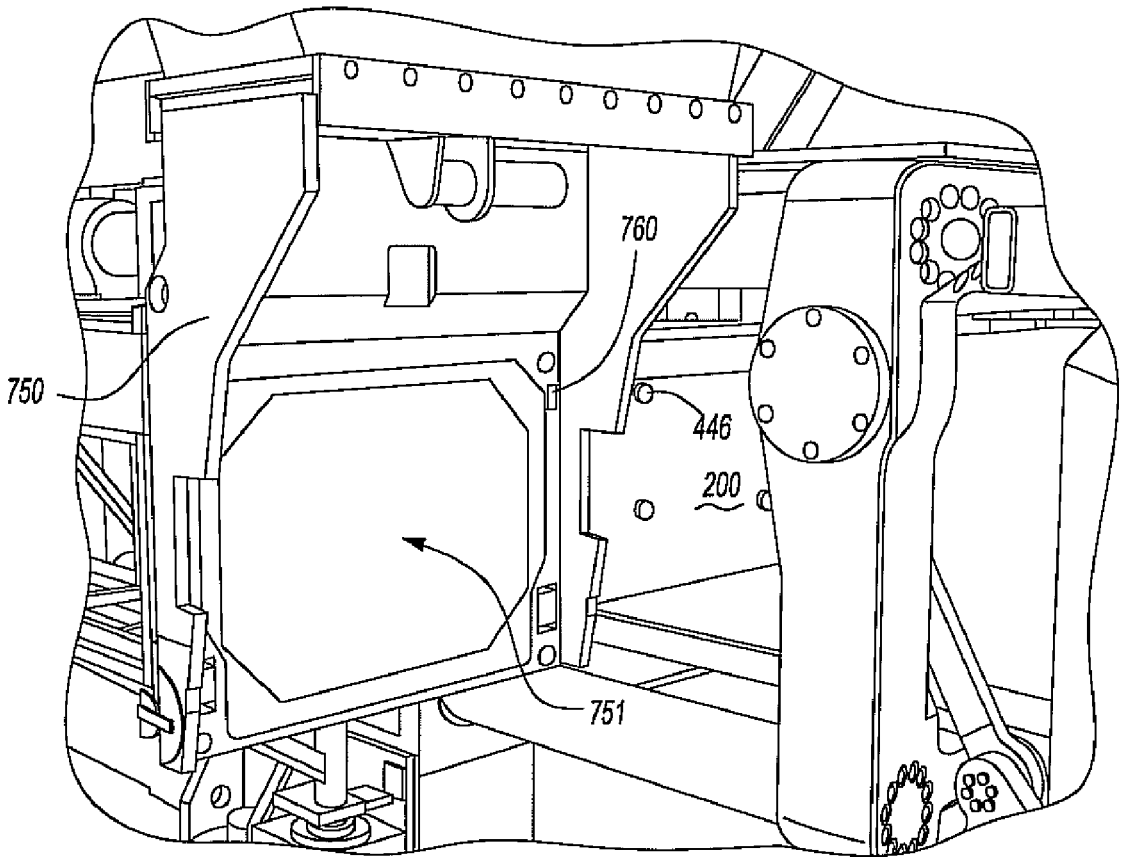
FIG. 20 is a perspective view of another portion of a core setter mast.

Turning now to FIG. 20, a read/write head 760 is shown on the mold string side 751 of the core setting mast 750. The read/write head 760 is operable to detect, read and write to a sensor located on the core mask (not shown). In this manner, the identification of a desirable core mask that has been attached to the core mast 750 can be assured. In addition, the identification of the core mask that has been attached to the core mast 750 can be used in assisting the setup of the molding machine operational parameters. In some instances, the identification of the mask attached to the mast 750 using the electronic read/write heads can prevent human error in the programming of the operational parameters for the sand casting molding machine. It is appreciated that the location of the read/write head 760 in FIG. 20 is for illustrative purposes only and can be located at any location such that it can detect, read and write to a corresponding sensor located on the core setting mask.

The pattern plates 410 and 420 can include a data carrier electronic device 412 and/or 422, respectively (FIG. 1) that are operable to store information such as molding machine parameters, position of mold clamps, the time at which sand is blown into the mold chamber, the air pressure used to blow the sand into the mold chamber, pressure used to push a completed mold to the end of the mold string, pressures used to squeeze the sand in the mold chamber and the like. This information can be used to optimize machine parameters, determine when best to switch a pattern plate and the like.

Figure 22:
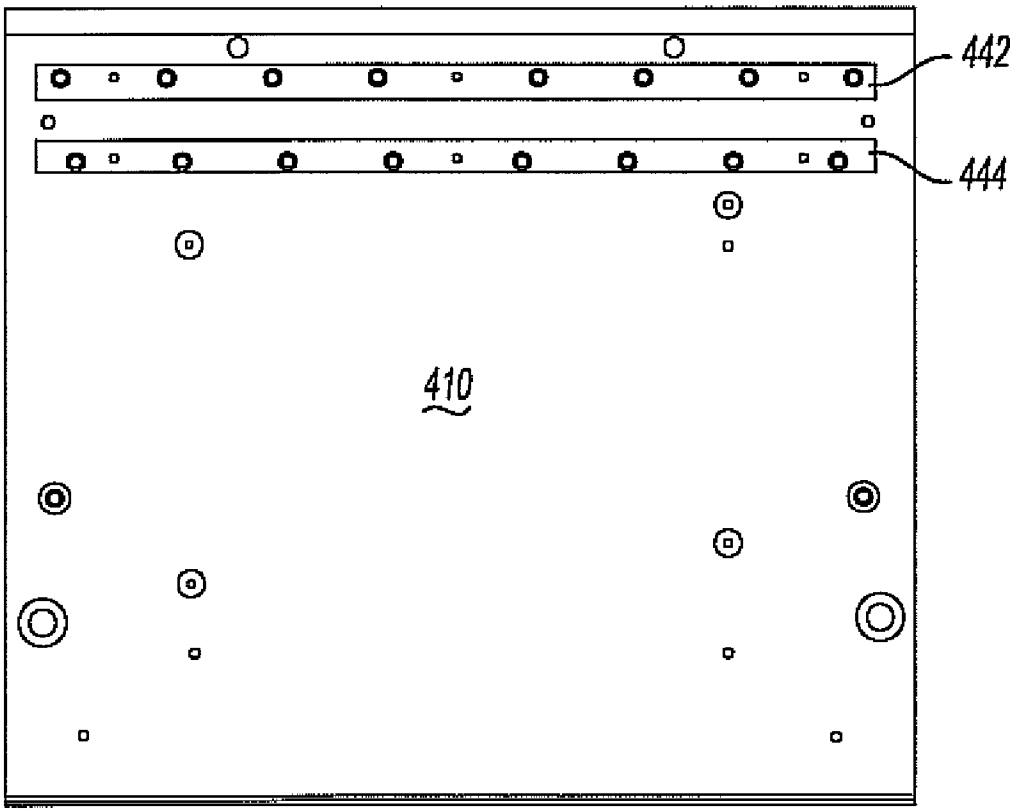
FIG. 22 is a rear view of a pattern plate.
Figure 21:
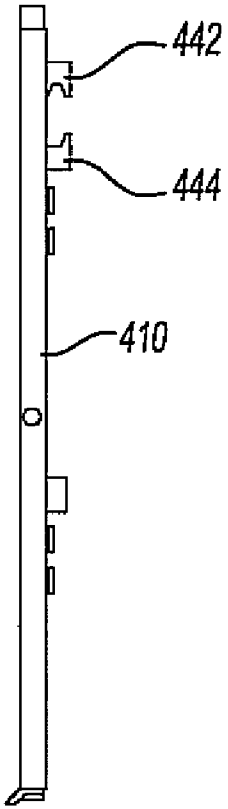
FIG. 21 is a side view of a pattern plate.

The pattern plates 410 and/or 420 can also include an optional first guide rail 442 and second guide rail 444 on a squeeze head side of the plate, as shown in FIGS. 21 and 22. The rails 442 and 444 can have a generally V- or U-shaped side that affords for a roller or fitting 446 (shown in FIG. 20) to fit at least partially within. In this manner, the pattern plate 410 and/or 420 can be more easily placed on the respective squeeze head by placing the roller or fitting 446 between the rails 442 and 444 and pushing the pattern plate to a desired location where the hydraulic pattern lock 390 can rigidly attach the plate to the squeeze head. It is appreciated that a single guide rail can be used such that the rail would ride on the roller or fitting 446. However, increased safety is provided by using two guide rails since the use of one guide rail can more easily result in the rail coming off of the roller or fitting and the pattern plate being dropped.

Figure 23:
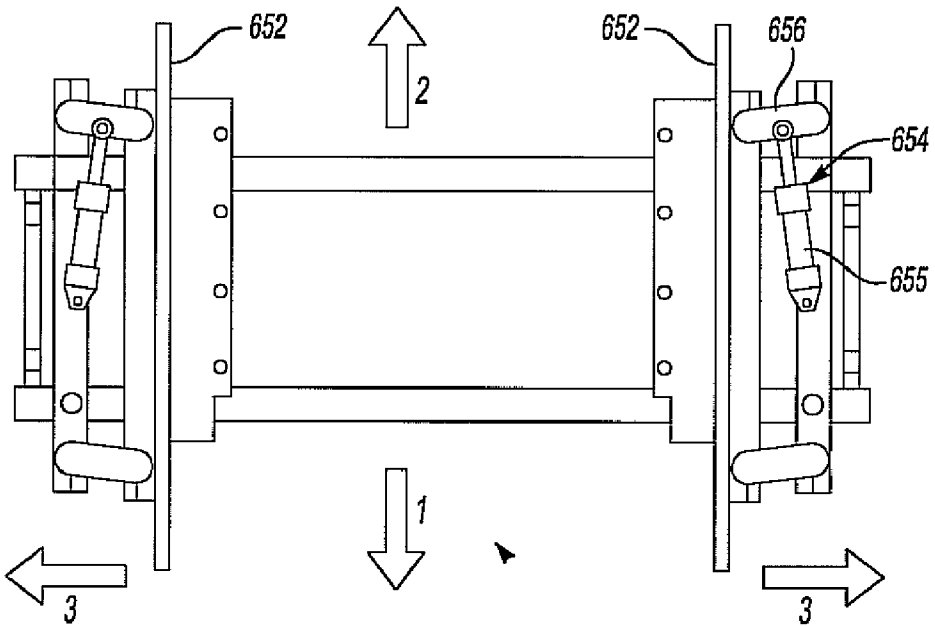
FIG. 23 is top view of the mold retention device shown in FIG. 16.

Once a mold half has been produced in the mold chamber 150, and the swingable squeeze head 200 has been moved to a generally horizontal position, the lateral squeeze head 300 is used to push the mold half to the end of the mold string. At this location, a mold retention device 650 (FIGS. 16 and 23) can be used to prevent the mold half and the mold string 800 from expanding back towards the mold chamber 150. The mold retention device 650 has at least one mold retention bar or plate 652, the mold retention bar 652 having a cam lever action 654 that affords for continuous pressure to be applied to the mold string at all times. The cam lever action 654 can include a hydraulic piston 655 that applies pressure to a cam arm 656. When the mold string moves in the first direction 1, the mold retention bar 652 is pushed in a generally outward direction 3. However, pressure is exerted on the cam arm 656 by the hydraulic piston 655, thereby resisting movement of the mold retention bar 652 in the generally outward direction 3. In this manner, the constant pressure is applied to a mold(s) in contact with the mold retention bar 652. The pressure is calibrated such that the mold string 800 can be pushed in the first direction 1, but if the mold string 800 starts to move in the second direction 2, the movement of the mold retention bars 652 in the second direction 2 also affords for their movement in a generally inward direction. The inward movement of the mold retention bar 652 provides a stopping force on the mold(s) and prevents the mold string 800 from moving in the second direction 2.

Figure 24:
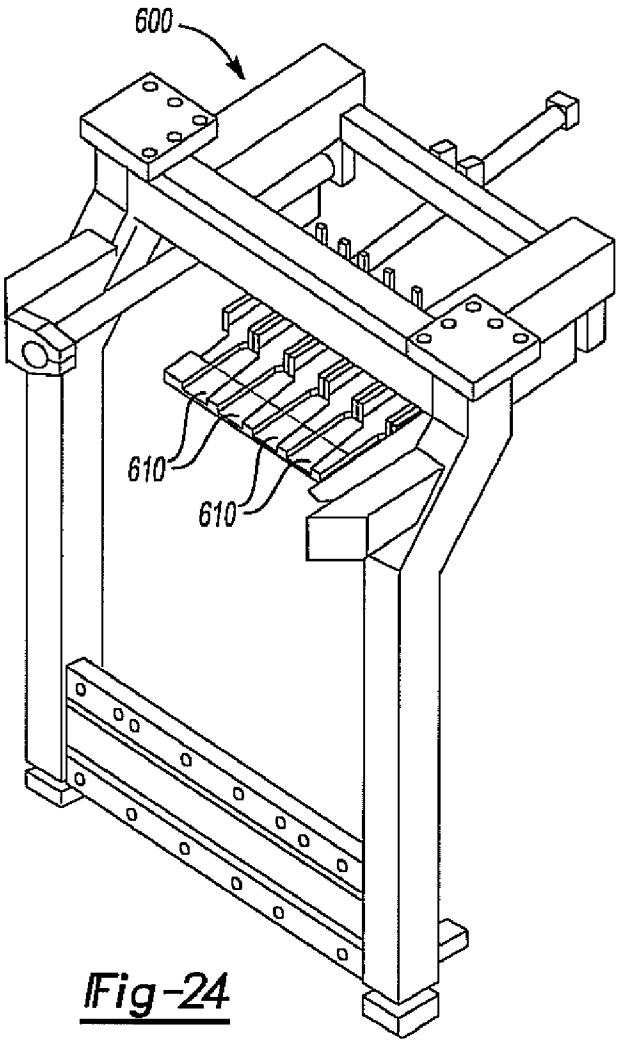
FIG. 24 is a top perspective view of a portion of the mold hold down shown in FIG. 16.

A mold hold down 600 can be included and as illustratively shown in FIGS. 16 and 24, the mold hold down 600 including a plurality of hold down clamps 610. The hold down clamps 610 can apply a clamp pressure onto a mold half without crushing the mold. As shown in FIG. 16, each clamp head 610 has its own control device 620, each control device 620 operating independently of the other control devices 620. Thus if an object is located on the top of the mold and is in the way of a mold clamp, for example a pour cup, the particular clamp head 610 or plurality of clamp heads 610 can be placed in an up state or an unactivated state. In this manner, the mold half can be held securely until double indexing of the mold string 800 is desired. In the alternative, the mold hold down 600 can slide in the first direction 1 such that the mold half is held securely during the double indexing of the mold half and mold string 800 and then return to an original position to hold down the next mold half placed at the end of the mold string 800.

Figure 25:
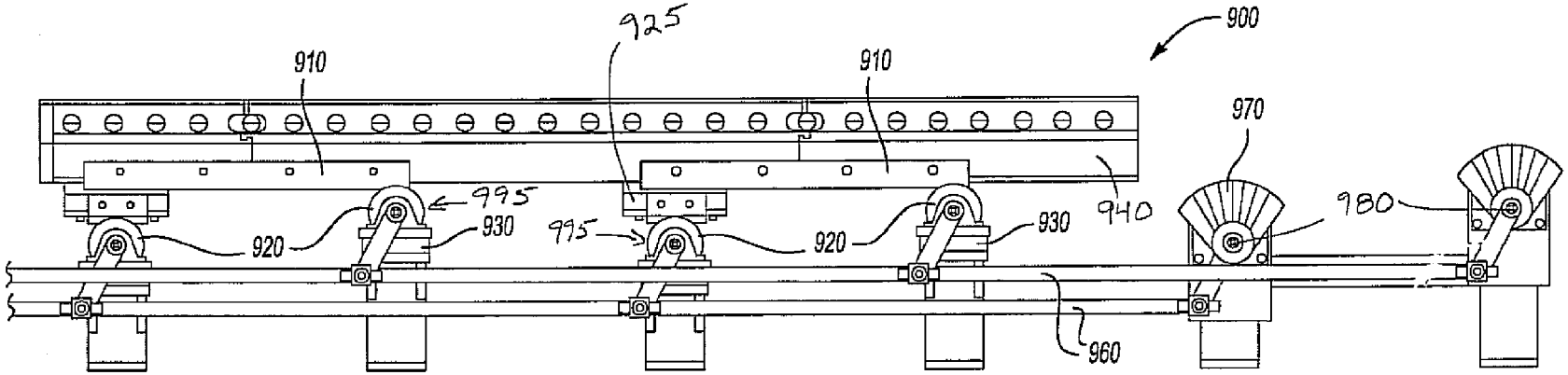
FIG. 25 is side view of a mold string conveyor.
Figure 26:
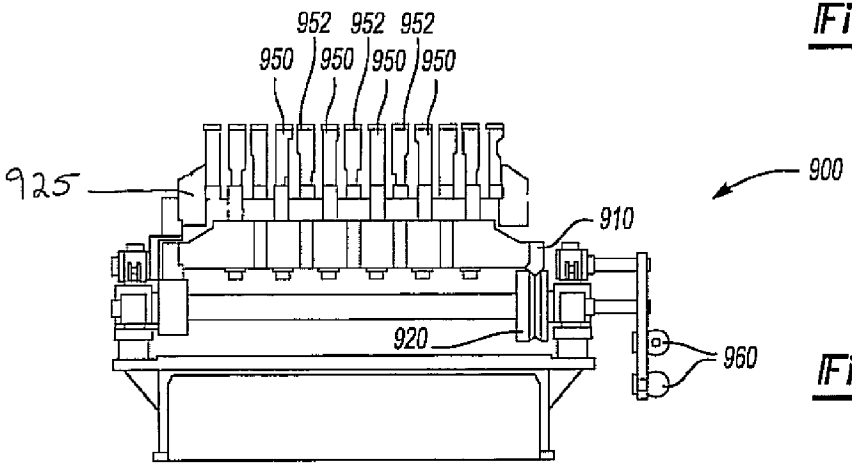
FIG. 26 is an end view of a mold string conveyor.

Turning now to FIGS. 25 and 26, a portion of the mold string conveyor is shown. The molding machine can include a walking beam mold conveyer 900 having two sets of rails 950 and 952 interconnected with splice plates 925. The splice plates 925, also known as waffles or grates, lie on rollers 920. Typically, each grate 925 is supported and then re-leveled with the molding machine and every other grate 925. One embodiment of the present invention affords a walking beam mold conveyer wherein each grate 925 is permanently attached to every other set of grates 925 using a connecting bar 940. The connecting bars 940 afford for alignment of the grate 925 not to be disturbed when rails 950 and 952 are removed for repair and/or replacement and thus additional support is not required.

The grates 925 are typically deterred from shifting sideways using thrust rollers (not shown). However, spatter created during the pouring process comes into contact with the thrust rollers causing damage thereto. When this occurs, each set of thrust rollers must be adjusted individually in order to keep the conveyer in a straight line. One embodiment of the present invention includes a V-roller 920 and a V-shape rail 910 to replace the thrust rollers. Realignment is not required since gravity is used to self center the V-shape rail 910 in the V-notch of the V-roller 920. Furthermore, the V roller 920 is under the conveyer and the potential for spatter during the pouring process is reduced.

Another embodiment improves the lifting of the rails 940 with the use of a rotary actuator 970 directly coupled to a lining cam shaft 980 as opposed to a linear actuator of prior art machines. The embodiment can also incorporate wedged adjuster blocks 930 directly under a bearing stand 995 which eliminates cantering of the stand 995, the use of a bolt and a jam nut to adjust the rail 950 and/or 952 height and the need to adjust both sides at any one time.

Mold conveyers of prior art molding machines use differential pressure valves to maintain a constant force on the mold string. However, differential pressure valves can cause different velocity profiles due to changing frictional forces and varying masses along the mold string. In contrast, one embodiment of the present invention controls the velocity (flow of oil) of the mold conveyer 900 and the resultant force (pressure) on the ram cylinder, thereby affording consistent accelerations, decelerations and constant velocities.

The foregoing drawings, discussion and description are illustrative of specific embodiments of the present invention, but they are not meant to be limitations upon the practice thereof. Numerous modifications and variations of the invention will be readily apparent to those of skill in the art in view of the teaching presented herein. It is the following claims, including all equivalents, which define the scope of the invention.

I claim:

1. A process for making sand molds, placing the molds in a mold string, double indexing the molds and pouring two castings simultaneously using a sand molding machine, the process comprising:

providing a first mold by blowing sand into a mold chamber and squeezing the sand with a lateral squeeze head and a swingable squeeze head;

pushing the first mold to an end of a mold string using the lateral squeeze head;

providing a second mold by placing sand into a mold chamber and squeezing the sand with a lateral squeeze head and a swingable squeeze head;

pushing the second mold adjacent to the first mold at the end of the mold string using the lateral squeeze head;

indexing the first mold and second mold a distance of two mold widths using the lateral squeeze head in a single stroke, a mold retention device, a mold hold down and a mold string conveyor; and pouring molten metal into two mold cavities that are at least partially within the first and second mold while two additional molds are being made and pushed to the end of the mold string.

2. The process of claim 1, wherein the lateral squeeze head has a lateral squeeze head cylinder with a cylinder linear sensor, the cylinder linear sensor monitoring the position of the lateral squeeze head cylinder relative to a bushing during operation of the sand molding machine.

3. The process of claim 1, wherein the lateral squeeze head has a first linear sensor monitoring the lateral movement of the lateral squeeze head and a second linear sensor monitoring the vertical movement of the lateral squeeze head during operation of the sand molding machine.

4. The process of claim 1, wherein the lateral squeeze head has a pair of round air shoes providing support to the lateral squeeze head above a wear sheet.

5. The process of claim 1, wherein the lateral squeeze head has at least one hydraulic pattern lock providing a rigid attachment of a pattern to the lateral squeeze head.

6. The process of claim 5, wherein the at least one hydraulic pattern lock has a contamination resistant system selected from the group consisting of a wear band, a scraper, a seal and combinations thereof, the contamination resistant system preventing contamination from entering an interior cylinder of the hydraulic pattern lock.

7. The process of claim 6, wherein the at least one hydraulic pattern lock has a central shaft with a locking cap removably attached thereto.

8. The process of claim 1, wherein the swingable squeeze head has at least two linear sensors monitoring the position of the swingable squeeze during operation of the sand molding machine.

9. The process of claim 1, wherein the swingable squeeze head has a swing pivot assembly providing an attachment for the swingable squeeze head to a yoke.

10. The process of claim 9, wherein the swing pivot assembly has a swing pivot pin at least partially within a self-lubricated bushing, the bushing providing radial support to the swing pivot pin.

11. The process of claim 9, wherein the swing pivot assembly has an angular ball bearing adjacent an outer cap, the angular ball bearing assembly providing axial support to the swing pivot pin.

12. The process of claim 11, wherein the outer cap has threads, the outer cap with the treads providing an axial adjustment for the position of the angular ball bearing assembly relative to the swing pivot pin.

13. The process of claim 1, wherein the core setting mast has a linear sensor monitoring the position of an adjustment box with a wedge-shaped surface, the adjustment box having a fixed distal relationship with alignment pins on the core setting mask.

14. The process of claim 1, wherein the mold retention device has at least one mold retention bar with a cam lever action assembly providing pressure to the mold string.

15. The process of claim 1, wherein the mold hold down has a plurality of independent operating mold hold down clamps independently applying a pressure onto a sand mold.

16. The process of claim 1, wherein the mold string conveyor has at least two sets of movable waffles, each set of movable waffles being attached to each other with at least one spreader bar.

17. The process of claim 16, wherein the mold string conveyor has a V-rail runner bar and V-rail runner bar bearing providing accurate alignment of the mold string and minimizing mold shifting.

18. The process of claim 1, wherein the mold string conveyer is a walking beam conveyer.

19. A sand casting molding machine for producing molds and then double indexing a mold string, said molding machine comprising:

a mold chamber;

a lateral squeeze head having at least one linear sensor and a hydraulic pattern lock;

a swingable squeeze head having at least one linear sensor and a swing pivot assembly;

a core setter having a servo motor and a double linkage system;

a mold retention device having a cam lever action;

a mold hold down having a plurality of clamp heads; and a mold string conveyor having at least two sets of movable waffles;

said lateral squeeze head, mold retention device, mold hold down and said mold string conveyor operable to double index a mold string by said lateral squeeze head in a single stroke.

20. The sand casting molding machine of claim 19, wherein a linear sensor is attached to said flange proximate said cylinder, said linear sensor operable to monitor the position of the cylinder relative to said bushing.

21. The sand casting molding machine of claim 19, wherein said lateral squeeze head has a first linear sensor operable to monitor the lateral movement of said lateral squeeze head and a second linear sensor operable to monitor the vertical movement of said lateral squeeze head.

22. The sand casting molding machine of claim 19, wherein said lateral squeeze head has a pair of round air shoes attached thereto, said pair of round air shoes operable to support said lateral squeeze head above a wear sheet.

23. The sand casting molding machine of claim 19, wherein said hydraulic pattern lock has a contamination resistant system selected from the group consisting of a wear band, a scraper, a seal and combinations thereof, said contamination resistant system operable to resistant contamination from entering an interior cylinder of said hydraulic pattern lock.

24. The sand casting molding machine of claim 19, wherein said hydraulic pattern lock has a central shaft with a locking cap removably attached thereto.

25. The sand casting molding machine of claim 19, wherein said swingable squeeze head has a first linear sensor operable to monitor the lateral position of said the swingable squeeze head and a second linear sensor operable to monitor the vertical position of said swingable squeeze head.

26. The sand casting molding machine of claim 19, wherein said swing pivot assembly has a swing pivot pin, a self-lubricating bushing, an ball bearing assembly and an outer cap.

27. The sand casting molding machine of claim 19, wherein said core setter has a core setting mast with an adjustment box and linear sensor attached thereto.

28. The sand casting molding machine of claim 27, wherein said core setting mast has an electronic read/write head attached thereto.

* * * * *

UNITED STATES PATENT AND TRADEMARK OFFICE

CERTIFICATE OF CORRECTION

PATENT NO. : 7,806,161 B2
APPLICATION NO. : 11/953610
DATED : October 5, 2010
INVENTOR(S) : Robert Jezwinski It is certified that error appears in the above-identified patent and that said Letters Patent is hereby corrected as shown below:

Column 1, line 46 - delete “lie” and insert --the--
Column 2, line 11 - delete “bead” and insert --head--
Column 10, line 57 - delete “lining” and insert --lifting--
Column 12, line 10 - delete “treads” and insert --threads--

Signed and Sealed this
Eighteenth Day of January, 2011

David J. Kappos

David J. Kappos
*Director of the United States Patent and Trademark Office*